US012421612B2

(12) United States Patent
Zavabeti et al.

(10) Patent No.: US 12,421,612 B2
(45) Date of Patent: Sep. 23, 2025

(54) ELECTROLYSIS OF CARBON DIOXIDE TO SOLID CARBON USING A LIQUID METAL CATHODE

(71) Applicant: Carbelec Pty Ltd, West Perth WA (AU)

(72) Inventors: Ali Zavabeti, West Perth WA (AU); Gang Li, West Perth WA (AU); Robin John Batterham, West Perth WA (AU); Rodney James Dry, West Perth WA (AU); Michael John Dry, West Perth WA (AU)

(73) Assignee: Carbelec Pty Ltd, West Perth WA (AU)

( * ) Notice: Subject to any disclaimer, the term of this patent is extended or adjusted under 35 U.S.C. 154(b) by 0 days.

(21) Appl. No.: 18/266,449

(22) PCT Filed: Nov. 26, 2021

(86) PCT No.: PCT/AU2021/051416
§ 371 (c)(1),
(2) Date: Jun. 9, 2023

(87) PCT Pub. No.: WO2022/120411
PCT Pub. Date: Jun. 16, 2022

(65) Prior Publication Data

US 2024/0044018 A1 Feb. 8, 2024

(30) Foreign Application Priority Data

Dec. 9, 2020 (AU) ..... 2020904569

(51) Int. Cl.
*C25B 1/135* (2021.01)
*C21B 5/00* (2006.01)
(Continued)

(52) U.S. Cl.
CPC ..... *C25B 1/135* (2021.01); *C21B 5/007* (2013.01); *C25B 1/02* (2013.01); *C25B 9/30* (2021.01);
(Continued)

(58) Field of Classification Search
None
See application file for complete search history.

(56) References Cited

U.S. PATENT DOCUMENTS 3,308,044 A 3/1967 Alexander et al.
8,858,777 B2 10/2014 Kaczur et al.
(Continued)

FOREIGN PATENT DOCUMENTS

CA 2625656 C 12/2014
WO 9401210 A1 1/1994
WO 2018075123 A1 4/2018

OTHER PUBLICATIONS

Esrafilzadeh, D., et al., Room Temperature CO2 Reduction to Solid Carbon Species on Liquid Metals Featuring Atomically Thin Ceria Interfaces, Nature Communications, 2019, 8 Pages, 10:8665. Retrieved from: https://www.nature.com/articles/s41467-019-08824-8.
(Continued)

*Primary Examiner* — Wojciech Haske
(74) *Attorney, Agent, or Firm* — HUSCH BLACKWELL LLP

(57) ABSTRACT

A process for producing solid carbon and gaseous oxygen from $CO_2$ via electrolysis using an electrolysis apparatus is disclosed. The apparatus includes a chamber with an electrolyte inlet, an electrolyte outlet, a liquid electrolyte containing $CO_2$ in the chamber, at least one cathode-anode pair, with the cathode including a liquid metal capable of catalysing reduction of $CO_2$ to solid carbon at a selected operating temperature of the process. The process includes causing the
(Continued)

*Embodiment A* electrolyte to flow from the inlet to the outlet in fluid communication with the cathode-anode pair, applying a voltage between the cathode-anode pair and causing solid carbon to form on the cathode from $CO_2$ in the electrolyte and gaseous oxygen to be evolved at the anode from $CO_2$ in the electrolyte.

18 Claims, 16 Drawing Sheets

(51) Int. Cl.
*C25B 1/02* (2006.01)
*C25B 9/30* (2021.01)
*C25B 15/027* (2021.01)
*C25B 15/08* (2006.01)

(52) U.S. Cl.
CPC ..... *C25B 15/027* (2021.01); *C25B 15/081* (2021.01); *C25B 15/083* (2021.01); *C25B 15/087* (2021.01)

(56) References Cited

U.S. PATENT DOCUMENTS 9,290,853 B2 3/2016 Elgammal et al.
10,494,728 B2 12/2019 Jakobsson et al.
2004/0025633 A1* 2/2004 Kanoshima ..... C21B 5/007 75/460
2012/0006690 A1 1/2012 Amendola et al.
2014/0202874 A1* 7/2014 Elgammal ..... C25B 15/08 205/555
2019/0055616 A1* 2/2019 Huang ..... C21B 5/007
2020/0378014 A1 12/2020 Licht

OTHER PUBLICATIONS

Dry et al., Steel from Uranium, Uranium 2020 Conference (Virtual), Oct. 14-15, 2020, 13 Pages.
International Energy Agency (IEA), Renewables 2020 Analysis and Forecast to 2025, Nov. 2020. 172 Pages, Retrieved from: https://www.iea.org/reports/renewables-2022?utmcampaign=IE%20newsletter&utmsource=SendGrid&utm_medium=email.
Wikipedia, Hydrogen Storage, 33 Pages, Retrieved from: https://wikipedia.org/wiki/Hydrogen_storage, Available since at least Dec. 8, 2020.
O'Brien et al., History of the Chlor-Alkali Industry, Handbook of Chlor-Alkali Technology: vol. I: Fundamentals, vol. II: Brine Treatment and Cell Operation, vol. III: Facility Design and Product Handling, vol. IV: Plant Commissioning and Support Systems, vol. V: Corrosion, Environmental Issues, and Future Development, Springer US, Boston, MA, 2005, pp. 17-36, Retrieved Oct. 5, 2020.
Stockholm Environment Institute (SEI), Hydrogen Breakthrough Ironmaking Technology (HYBRIT) is a Ground-breaking Effort to Reduce CO2 Emissions and De-carbonise the Steel Industry, 2019. 4 Pages, Retrieved from: https://www.sei.org/projects-and-tools/projects/hybrit/.
Greener Industry UK, Chlorine. Retrieved from: http://www.greener-industry.org.uk/pages/chlorine/6chlorine.PM1.htm, 6 pages, Available since at least Dec. 8, 2020.
International Search Report and Written Opinion for Application No. PCT/AU2021/051416 dated Feb. 10, 2022 (8 pages).

* cited by examiner

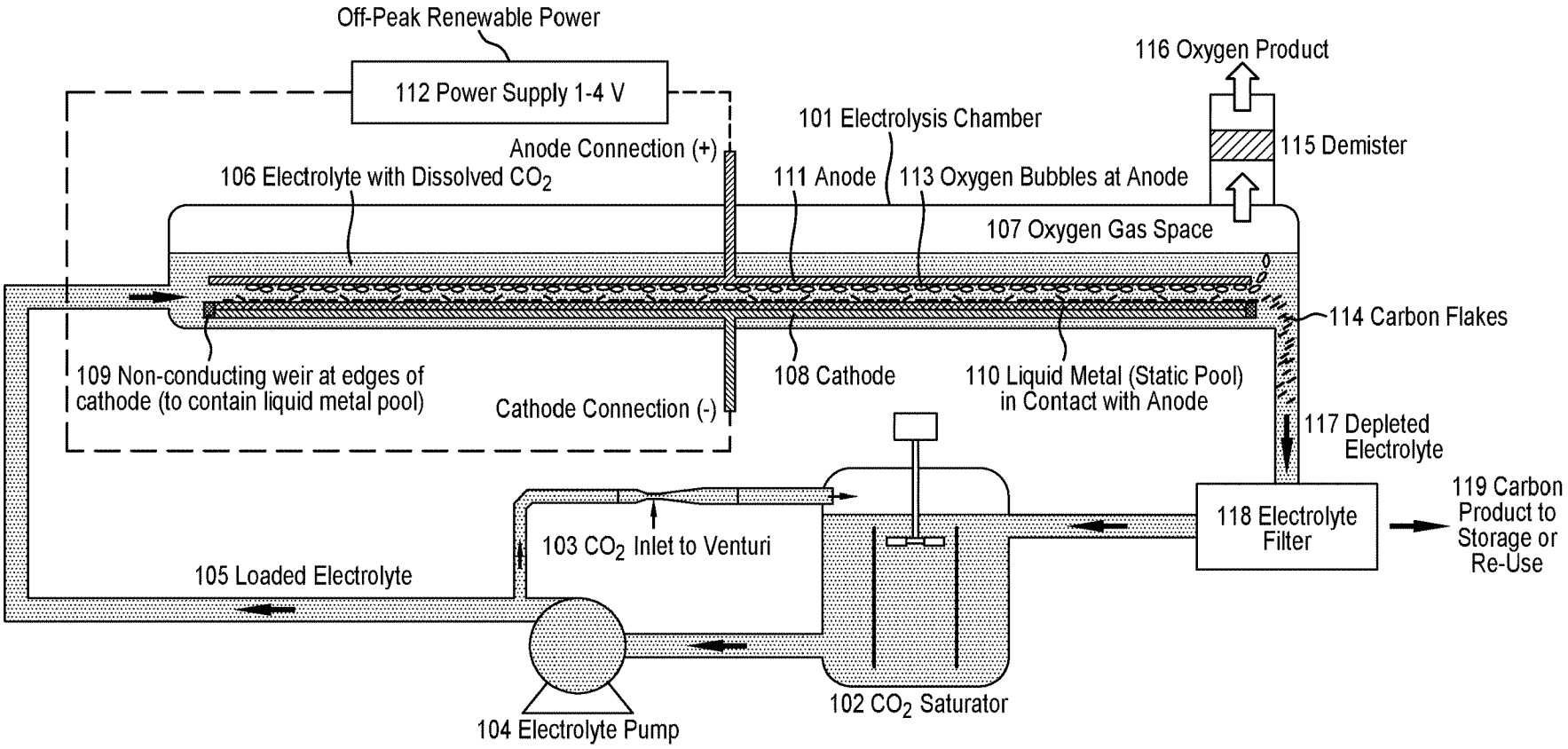
*Figure 1 - Embodiment A*

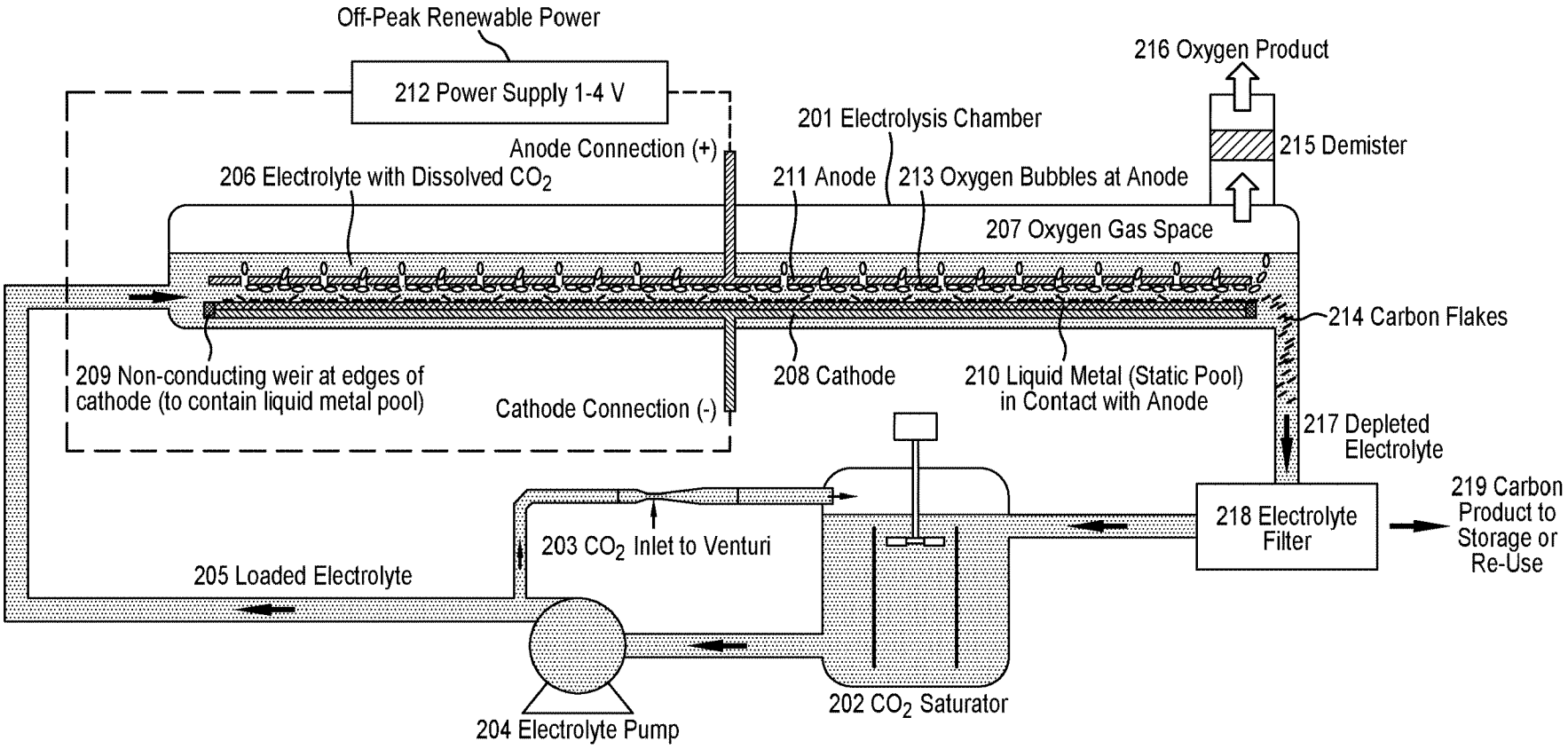
*Figure 2 - Embodiment B*

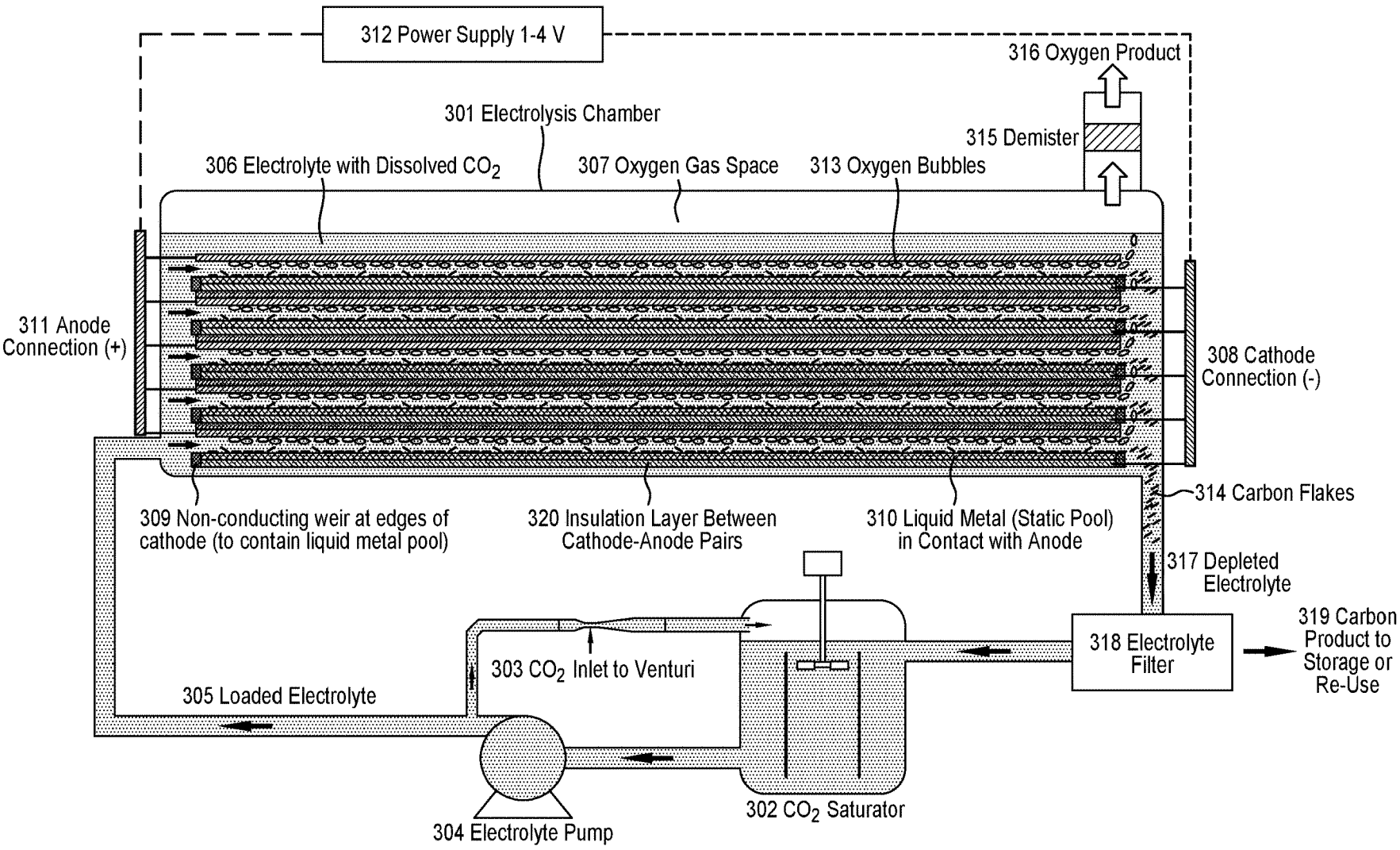
*Figure 3 - Embodiment C*

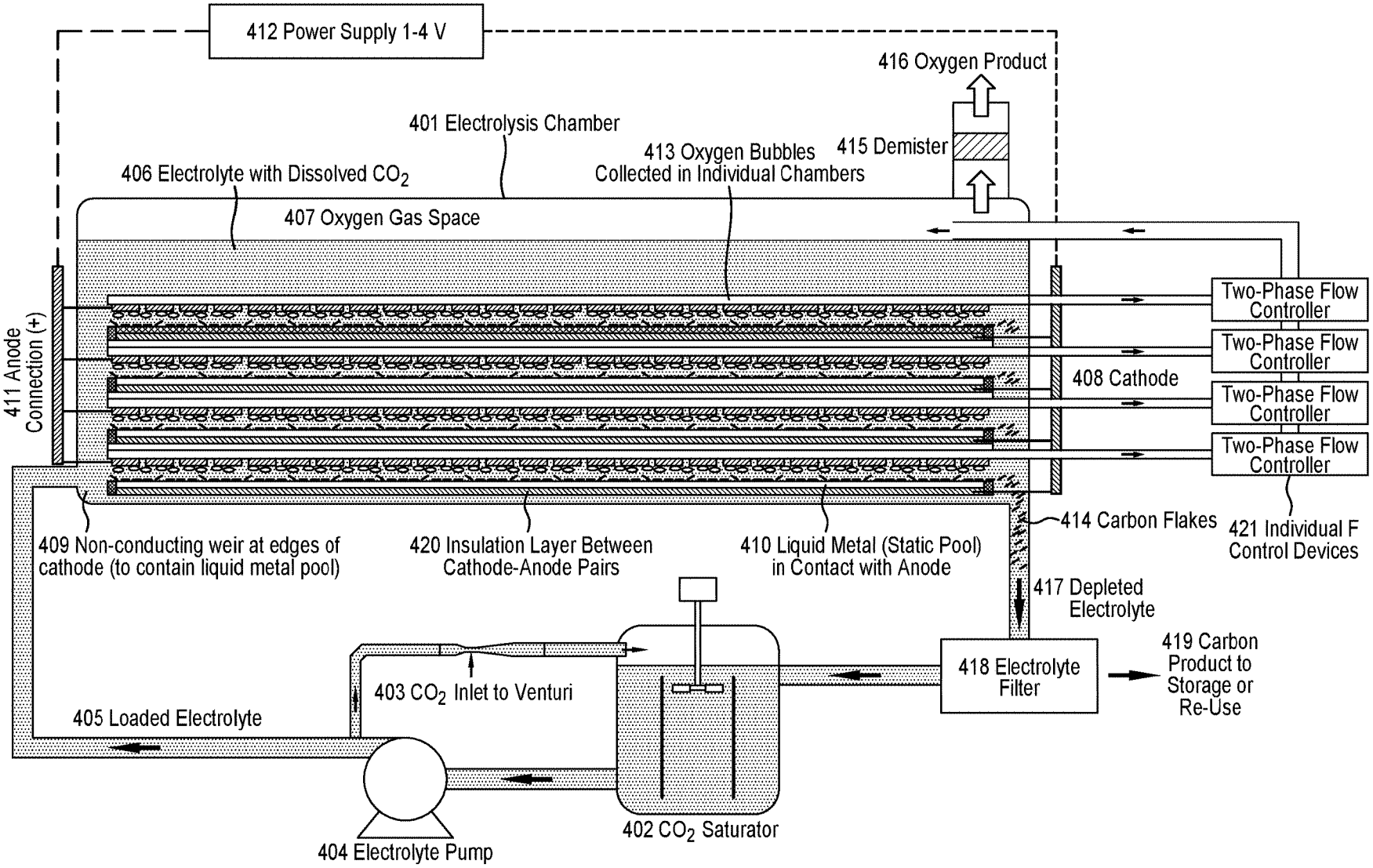
*Figure 4 - Embodiment D*

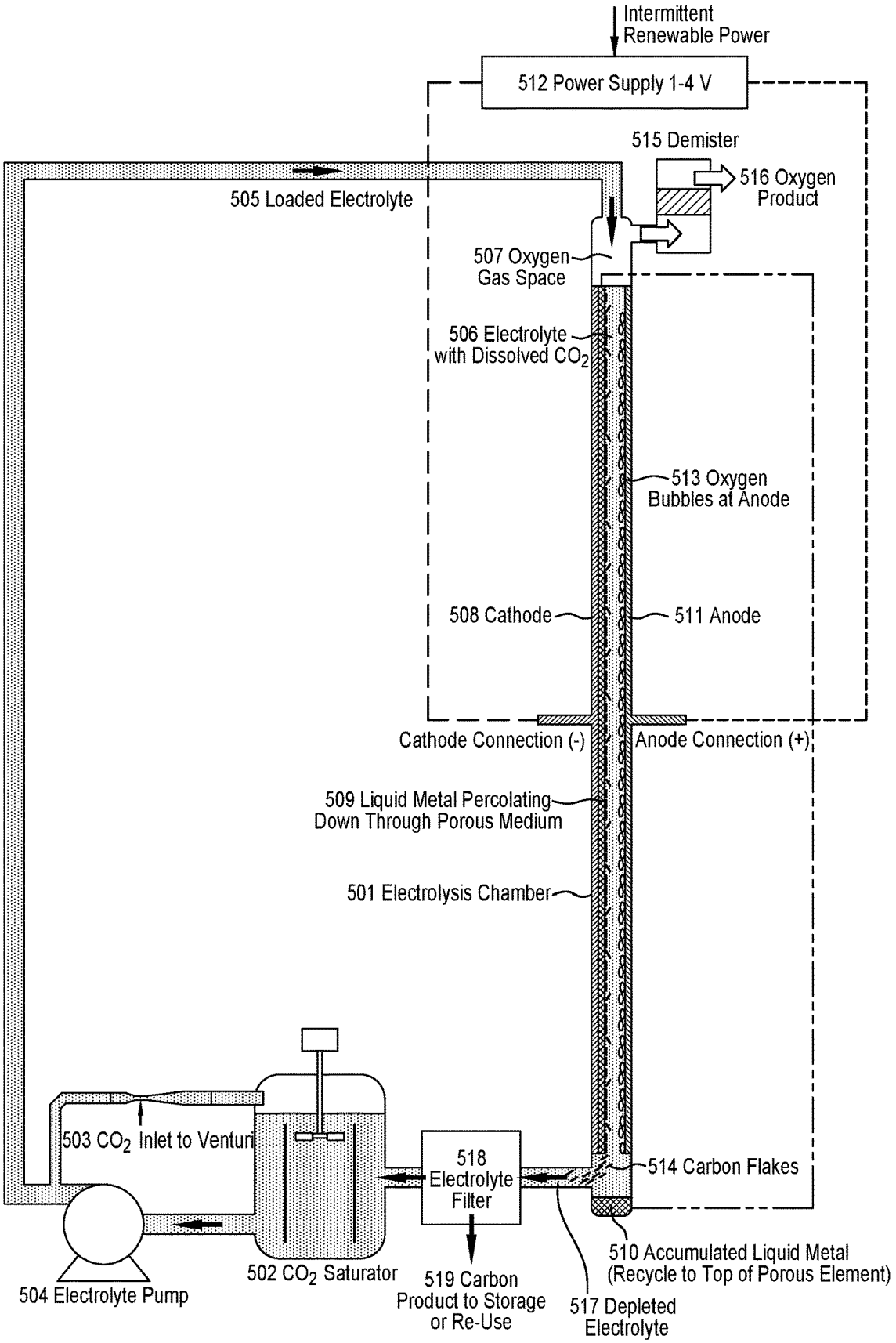
*Figure 5 - Embodiment E*

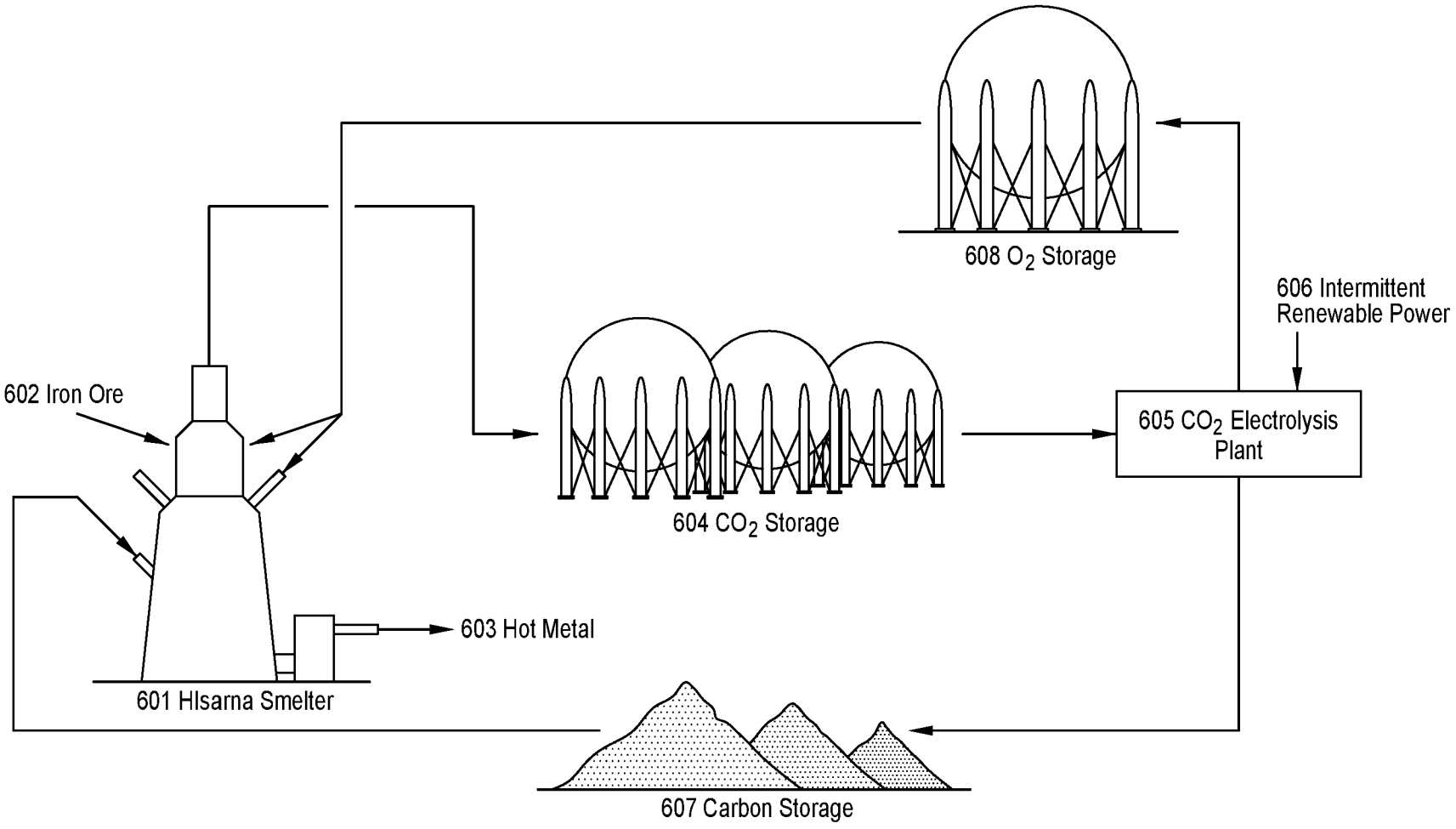
*Figure 6 - HIsarna Direct Smelting Application*

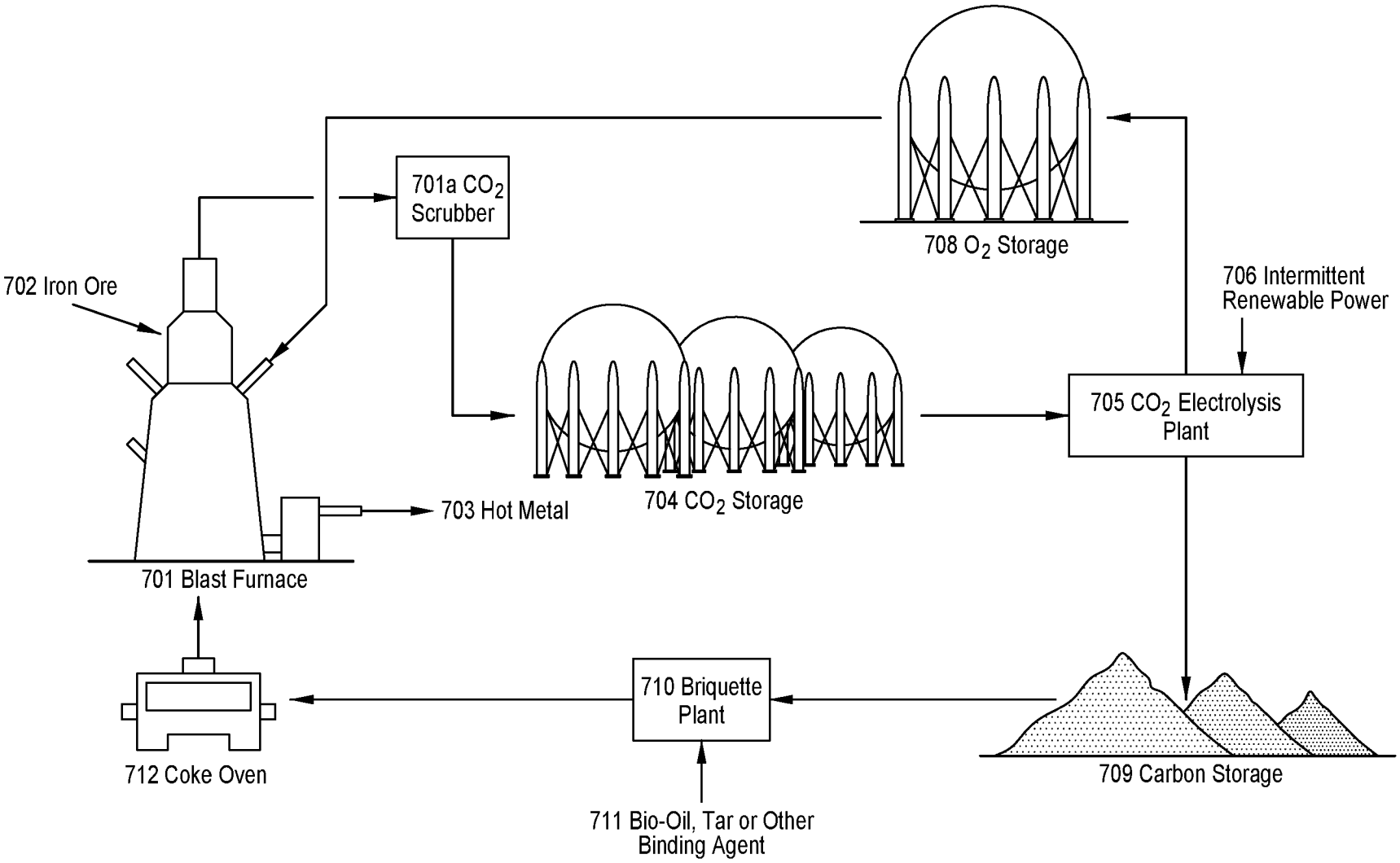
*Figure 7 - Synthetic Coke BF Application*

Current density curve of Experiment 1 for the electrolysis using a solution of 66wt% MEA + 34wt% water and 0.1M $NH_4BF_4$ An image of the experimental setup of the electrolysis apparatus An image of the electrolysis apparatus in Experiment 1 after electrolysis Images of the SEM and EDS results of the carbon product of Experiment 1

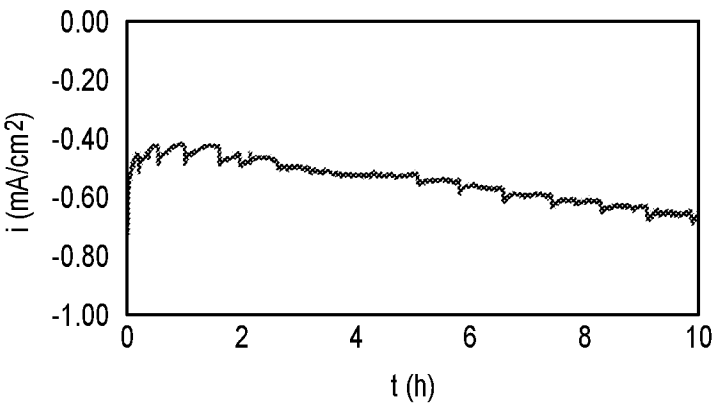
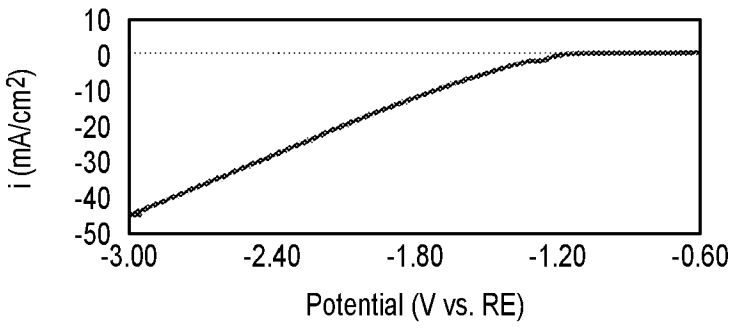
Current density curves of Experiment 2 for the electrolysis using a solution of 10wt% PEI + 90wt% water and 0.1M $NH_4BF_4$
*Figure 12*

An image of the electrolysis apparatus in Experiment 2 after electrolysis

Current density curve of Experiment 3 for the electrolysis using a solution of pure MEA and 0.1M $NH_4BF_4$ + 2.5M $H_2O$ An image of the electrolysis apparatus in Experiment 3 after electrolysis Current density curve of Experiment 4 for the electrolysis using electrolytes having different concentrations of DMF + MEA + 0.05M $NH_4BF_4$ + 1M $H_2O$ An image of the electrolysis apparatus in Experiment 4 after electrolysis $CO_2$ absorption curve for different concentration of MEA in a solution in Experiment 4

ELECTROLYSIS OF CARBON DIOXIDE TO SOLID CARBON USING A LIQUID METAL CATHODE

CROSS REFERENCE TO RELATED APPLICATIONS

This application is a national stage application filed under 35 U.S.C. § 371 of International Patent Application No. PCT/AU2021/051416 filed Nov. 26, 2021, which claims priority to AU 2020904569 filed Dec. 9, 2020, both of which are incorporated herein by reference in their entireties.

TECHNICAL FIELD

The present invention relates to an electrolysis process and apparatus for producing solid carbon and gaseous oxygen from carbon dioxide.

The present invention relates particularly, although by no means exclusively, to an electrolysis process and apparatus for producing solid carbon and gaseous oxygen from carbon dioxide using an electrolyte containing $CO_2$ and a cathode that includes a liquid metal, as described herein, capable of catalysing reduction of $CO_2$ to solid carbon at a selected operating temperature of the apparatus/process.

The term "solid carbon" is understood herein to refer to carbon in a solid state that may contain some residual oxygen (generally <20%, typically <15%, by weight on a dry basis). This oxygen typically comes from the original carbon dioxide from which the solid carbon was produced.

The term "liquid metal" is understood herein to refer to any metal-containing substance that is at least partially liquid at a selected operating temperature of the process and is capable of catalysing reduction of $CO_2$ to solid carbon under the operating conditions of the process. The metal-containing substance may be a single metal, an alloy, or metal containing additives, with the additives being metals or non-metals.

BACKGROUND

Climate change is driving a fundamental re-evaluation of future options for energy-intensive industries such as power generation, steel and cement production. Renewable energy is seen as key part of this. According to a recent IEA report, installed capacity of wind and solar PV will become dominant over all other forms of power generation by about 2024 (1).

The intermittent nature of wind and solar PV power generation is a problem that will need to be managed. Large-scale energy storage systems (e.g. pumped hydro, static batteries etc) will contribute significantly but are unlikely to provide anything approaching complete coverage. This means renewable energy will, at times, be produced in excess relative to demand (including satiated local energy storage). An agile, scalable technology that is able to utilise this intermittent (hence low cost) power is therefore highly attractive (at least in principle).

One option under study (particularly in Europe) is hydrogen production and utilisation. The concept is that intermittent green power can be used to electrolyse water, and the resulting hydrogen used for a variety of tasks including green steel production via the DRI-EAF route (2). Water electrolysis plants can (in general) start and stop in a few minutes and are therefore agile enough to follow the availability of intermittent renewable energy. However, on the hydrogen consumption side, DRI plants (in particular) run at elevated temperatures and need to operate in steady-state. To bridge this, large amounts of hydrogen buffer storage are needed.

Hydrogen storage as a pressurised cryogenic liquid is difficult, though not impossible (e.g. LH2 storage site at Kobe Port, Japan, 3). Extremely low temperatures are needed (within about 20-40 K of absolute zero), implying significant energy losses and relatively high cost. Alternatives involving pressurised hydrogen storage in depleted gas reservoirs and salt caverns are currently preferred, although this necessarily implies a need for favourable local geological storage structures.

There is little doubt that hydrogen produced via electrolysis of water using intermittent power will become a significant part of the future energy landscape. However, hydrogen storage issues are challenging—this will most likely limit its use to certain parts of the world where favourable geological structures are available.

The concept of an electrolysis cell for $CO_2$, similar in principle to an electrolysis cell for making hydrogen from water, is not new.

A body of information exists relating to the production of either formic acid or synthesis gas via electrolysis of $CO_2$ (4-6). Whilst the production of synthetic fuels and chemicals via this route will no doubt contribute, this does not represent a scalable solution to the overall problem. In particular, the demand for synthetic chemicals is likely to dominate how much can be produced. The synthetic fuel route is more open in terms of demand-side tonnage, but $CO_2$ will still ultimately be released into the atmosphere. This approach, when based on fossil carbon dioxide, is one of "re-purposing" $CO_2$ to use it a second time and delay its release, rather than actually dealing with the core problem.

There is currently no commercially-operating technology for electrolysing $CO_2$ directly to solid carbon and gaseous oxygen. One potential reason for this is a long-standing problem of carbon fouling of cathodes of electrolysis apparatus. Since the product of the electrolysis reaction is a solid, it is clear that electrode fouling needs to be managed.

The above description is not to be taken as an admission of the common general knowledge in Australia or elsewhere.

SUMMARY OF THE DISCLOSURE

The invention is based on a realisation that recent experimental work (7) carried out by a RMIT-affiliated group provides an opportunity for an electrolysis process and apparatus for producing solid carbon and gaseous oxygen from carbon dioxide that is not subject to the cathode-fouling problem.

The RMIT-affiliated group has demonstrated Galinstan (a non-toxic mercury-like metal with low melting temperature, an alloy of gallium, indium and tin) containing cerium can produce solid carbon particles that do not foul a cathode. Their experiment involved a single drop of liquid metal and a "thimble-scale" container of dimethylformamide-based electrolyte containing $CO_2$, (and water) operating at ambient temperature. With a voltage in a range of negative 1.2 to 2.1 V, carbon flakes formed on the liquid metal cathode surface and subsequently detached. This solid carbon product was found to contain around 15% residual oxygen. Ce is only partly soluble in the liquid metal (around 0.5%, compared to doping at typically 3%). The remaining cerium was initially encapsulated as nanoparticles inside the liquid metal. Under ambient conditions $Ce_2O_3$ formed on the surface due to its high reactivity with oxygen. Whilst not wishing to be bound by the following comments, the mechanism appears to involve sub stoichiometric cerium oxides, $Ce_2O_3$ and Ce atoms interacting with a $CO_2$ molecule, exchanging electrons and leading to solid carbon plus higher oxide states of Ce (including $CeO_2$). The resulting cerium oxide is then thought to interact with the electrolyte at lower voltages than 1.2 V with reference to an Ag/Ag+(10 mM $AgNO_3$ in acetonitrile) electrode, regenerating Ce electrolytically at/near the interface whilst releasing oxygen into the electrolyte as hydroxide ions (for subsequent release as oxygen gas at the anode). Early indications are that faradic efficiency will be similar to that of a typical water-hydrogen electrolysis cell (around 70%).

The present invention is an electrolysis process and an electrolysis apparatus for reducing $CO_2$ via electrolysis and producing solid carbon and gaseous oxygen at an industrial scale.

The invention provides a process for producing solid carbon and gaseous oxygen from $CO_2$ via electrolysis using an electrolysis apparatus having a chamber with an electrolyte inlet, an electrolyte outlet, a liquid electrolyte containing $CO_2$ in the chamber, at least one cathode-anode pair, with the cathode including a liquid metal as defined herein capable of catalysing reduction of $CO_2$ to solid carbon, the process including supplying the electrolyte to the chamber via the inlet and discharging the electrolyte from the chamber via the outlet with the electrolyte flowing from the inlet to the outlet in fluid communication with the cathode-anode pair, applying a voltage between the cathode-anode pair and causing solid carbon to form on the cathode from $CO_2$ in the electrolyte and gaseous oxygen to be evolved at the anode from $CO_2$ in the electrolyte, and discharging solid carbon by transporting solid carbon from the cathode in the electrolyte to the electrolyte outlet and from the chamber via the outlet, and discharging gaseous oxygen from the chamber, for example via a gas outlet.

The invention also provides an electrolysis apparatus for producing solid carbon and gaseous oxygen from $CO_2$ via electrolysis, the apparatus including a chamber with an electrolyte inlet, an electrolyte outlet, a liquid electrolyte containing $CO_2$ in the chamber, at least one cathode-anode pair, with the cathode including a liquid metal as defined herein capable of catalysing reduction of $CO_2$ to solid carbon.

The applicant has realised that the scalability of the process/apparatus of the invention differs significantly from that of a water-hydrogen system. In particular, $CO_2$ can be stored as a pressurised, mildly cryogenic liquid with relative ease (typically −30° C. and 15 bar pressure).

Product solid carbon can be stored as a solid in virtually any amount needed (typically submerged in water for safety reasons, much like storage of reactive coals). By comparison, hydrogen storage (in the absence of suitable underground geology) as a cryogenic liquid in tanks requires extreme conditions (−253° C. and 5 bar pressure). This makes it significantly more costly and less attractive.

Both $CO_2$-carbon and $H_2O$-hydrogen electrolysis systems release gaseous oxygen at an anode. In many cases, this oxygen will simply be vented, although in some it may be worth collecting and storing as a cryogenic liquid. Storage conditions are somewhat more challenging compared to those for $CO_2$ (typically −150° C. and 10 bar pressure) but are still nowhere near requirements for liquid hydrogen. For any given oxygen-consuming process, a decision relating to whether or not liquid oxygen storage is appropriate will be a function of local cost factors. This involves comparing the cost of captured and recovered oxygen (considering the buffer volume and liquefaction energy demand) with that of oxygen from a continuously operating air separation plant.

The solid carbon may be in the form of particles or flakes or in any other suitable form.

The process may include maintaining a pressure, such as 0-50 barg, typically 0-30 barg, in the chamber.

The process may include supplying the electrolyte at a temperature, such as up to 200° C., and typically as up to 160° C., to the chamber.

The process may include operating the process at any suitable voltage between the cathode-anode pair.

The applied voltage may be in a range of 1 to 10 volts, typically 2-6 volts.

The term "applied voltage" is understood herein to mean a voltage applied to a circuit from an external power supply. Voltage is a difference in electrical potential between two points in a circuit, such as a cathode and an anode. Applied voltage is the voltage applied to a circuit to generate a potential difference between two points in the circuit.

The selection of the liquid metal in any given situation is dependent on a range of factors including but not limited to the operating parameters of the process, such as pressure, voltage, electrolyte composition and temperature.

The liquid metal may be any metal-containing substance that is at least partially liquid at a selected operating temperature of the process and is capable of catalysing reduction of $CO_2$ to solid carbon under the operating conditions of the process.

The liquid metal may be cerium-containing Galinstan.

The metal-containing substance may be a single metal, an alloy, or a metal/metal alloy containing an additive, with the additive being a metal or a non-metal.

The additive may include a catalytic/redox active agent (such as cerium).

The catalytic/redox active agent (such as cerium) may be in the form of nano-particles.

The metal-containing substance may be selected so that it does not decompose under the operating conditions of the apparatus.

Examples of possible liquid metals include a variety of known low-melting point metals and metal alloys such as Field's Metal (32.5% bismuth, 16.5% tin, 51% Indium, melting temperature 62° C.) and Wood's Metal (50% bismuth, 10% cadmium, 26.7% lead, 13.3% tin, melting temperature 70° C.).

There are many other possible combinations of metals and metal alloys that melt in a low temperature range of 40-50° C., typically 47-64° C., such as (for example) a combination of 44.7% bismuth, 5.3% cadmium, 22.6% lead and, 8.3% tin and 19.1% indium which melts at 47° C.

Mercury is also an option for the liquid metal cathode. It is already used in chlor-alkali electrolysis cells and, with appropriate safeguards, is potentially suitable for this purpose.

Gallium-Indium eutectic alloy (EGaIn) is also an option for the liquid metal cathode.

The electrolyte may be any suitable electrolyte that is a liquid at the operating temperature of the process and contains $CO_2$ as a part of the electrolyte. The electrolyte may contain $CO_2$ in solution. The electrolyte may include a component to which $CO_2$ may be bound in some way. The $CO_2$ may be in an ionic form. The key requirements are that the electrolyte be liquid at the operating temperature of the process and be able to contain sufficient $CO_2$ for the process to operate effectively.

The phrase "liquid electrolyte containing $CO_2$" is understood herein in the widest possible, non-limiting terms. The word "containing" covers $CO_2$ in any form in the liquid electrolyte, including ionic, chemically bound, and in solution. Basically, the liquid electrolyte is a medium for making $CO_2$ available for electrolysis.

The electrolyte may include dimethylformamide (DMF).

The electrolyte may include water and a chemical species to increase the amount of $CO_2$ contained in the electrolyte. Examples include aqueous amines such as ethanolamine (MEA) or methyl diethanolamine (MDEA). Other examples include alkaline salts dissolved in water, such as alkaline carbonate salts, such as potassium hydrogen carbonate, dissolved in water.

Both of the above examples (amines and alkaline salts) use a form of "chemical hook" to increase the amount of $CO_2$ that is held in the electrolyte in the liquid phase. The invention is not confined to this mechanism.

If the electrolysis cell is configured to operate at elevated pressure, i.e. above atmospheric pressure, then a range of physical absorbents such as propylene carbonate (Flour Solvent), DMPEG (Selexol) and methanol (Rectisol) may also be considered.

The $CO_2$ may be transferred to the electrolyte in any suitable way.

The process may include separating solid carbon from the electrolyte discharged from the electrolyte outlet and returning the electrolyte to the chamber via the electrolyte inlet.

The process may include regenerating the electrolyte by adding $CO_2$ to the electrolyte before returning the electrolyte to the chamber via the electrolyte inlet.

The process may include supplying $CO_2$ to the chamber, such that the $CO_2$ transfers to the electrolyte within the chamber. As noted above, the $CO_2$ may be in any form in the electrolyte, such as ionic, chemically-bound, and in solution.

The process may include agitating the liquid metal via mechanical, ultrasonic or other means to promote removal of solid carbon from the cathode.

The process may include supplying the electrolyte to the chamber so that the electrolyte flowing through a gap between the cathode and the anode has a superficial liquid velocity in a range of 0.05-5 m/s, typically at least 0.05 m/s, and typically less than 5 m/s.

The superficial liquid velocity may be in a range of 0.1-1 m/s.

The cathode may include a tray having a base and a perimeter side wall extending upwardly from the base that contains the pool of the liquid material.

An average separation distance between a surface of the cathode liquid metal and a facing surface of the anode may be in a range 10-100 mm, typically at least 10 mm, and typically less than 100 mm.

The average separation distance between the surface of the cathode liquid metal and the facing surface of the anode may be in a range 30-60 mm.

The cathode may include a base and a perimeter side wall extending upwardly from the base that defines a tray that contains the pool of the liquid metal.

With this arrangement, the cathode may be positioned substantially horizontally within the chamber, such as up to 10 degrees from a horizontal orientation.

The cathode may include a flow-restricting element across or through which the liquid metal can flow downwardly that is arranged at an angle to a horizontal orientation and, by way of example is vertical, with the liquid metal being retained on or in the flow-restricting element and in fluid communication with the electrolyte flowing from the electrolyte inlet to the electrolyte outlet.

By way of example, the flow-restricting element is formed and positioned in the chamber so that the liquid metal can percolate, typically slowly, under gravity through the flow-restricting element from an upper liquid metal inlet to a lower liquid metal outlet.

The flow-restricting element may be a porous element, a mesh-based element or a solid element having a series of surface features that cause a flow restriction.

The anode may be in any suitable form. Typically, the profile of the anode is complementary to that of the cathode to maintain the spacing between facing anode and cathode surfaces at least substantially constant.

The anode may be a plate, with or without apertures.

The anode may be a mesh.

The electrolyte may be any suitable liquid that can contain $CO_2$ in solution.

The electrolyte may include dimethylformamide containing $CO_2$.

The invention also provides a process for producing solid carbon and gaseous oxygen from $CO_2$ via electrolysis using an electrolysis apparatus having a chamber with an electrolyte inlet, an electrolyte outlet, a pool of a liquid electrolyte containing $CO_2$ in the chamber, at least one cathode-anode pair immersed in the electrolyte pool, with the cathode including a pool of a liquid metal as defined herein capable of catalysing reduction of $CO_2$ to solid carbon with a depth of 1-50 mm, the process including maintaining a pressure of 0-50 barg in the chamber, supplying the electrolyte at a temperature up to 200° C. to the chamber via the inlet and discharging the electrolyte from the chamber via the outlet, with the electrolyte flowing from the inlet to the outlet in fluid communication with the cathode-anode pair, applying a voltage in a range of 1 to 10 volts between the cathode-anode pair and causing solid carbon to form on the cathode from $CO_2$ in the electrolyte and gaseous oxygen to be evolved at the anode from $CO_2$ in the electrolyte, and discharging solid carbon by transporting solid carbon from the cathode in the electrolyte to the electrolyte outlet and from the chamber via the outlet, and discharging gaseous oxygen from the chamber for example via a gas outlet.

The depth of the liquid metal pool may be 5-20 mm, typically less than 20 mm.

The temperature of the electrolyte supplied to the chamber may be between ambient and 90° C., typically less than 85° C.

The process may include maintaining the pressure at between 0-30 barg, typically less than 30 barg, typically between 0-15 barg.

The process may include applying the voltage in a range of 1-6 volts, typically less than 6 volts, between the cathode-anode pair.

The process may include applying the voltage in a range of 1.5-3 volts between the cathode-anode pair.

The electrolysis process and apparatus of the invention provides new opportunities for climate mitigation. Potential applications, by way of example only, include:

1. Centralised industrial $CO_2$ collection with buffer storage and subsequent electrolysis using renewable power. The resulting carbon could then be sequestered by burying (e.g. in disused local mines) as a means of permanent sequestration.
2. Remote, autonomous machines could capture $CO_2$ from the air using locally generated wind/solar PV energy. The resulting $CO_2$ could then be electrolysed to solid carbon which is then sequestered locally (e.g. by burying it).

3. Industrial process that currently use oxygen and coal could be adapted to capture and store $CO_2$, then electrolyse it back to carbon and oxygen. These products could then be recycled back into the process (via storage buffers)—thereby creating a closed loop which avoids any release of carbon dioxide into the atmosphere.

An example of the last application is an HIsarna™ direct smelting process.

Another example is based on using recovered carbon in conjunction with bio-oil (from another source) to produce synthetic coke that can be used in blast furnaces.

The invention provides a process for producing iron that includes: producing solid carbon and gaseous oxygen in accordance with the above-described electrolysis process, and supplying iron ore, gaseous oxygen and a source of carbon to a direct smelter and direct smelting iron ore to molten iron and producing an off-gas containing $CO_2$, with the carbon source for the direct smelter including solid carbon produced in the electrolysis process, and with $CO_2$ in the off-gas from the direct smelter being used in the electrolysis process.

The process may include using gaseous oxygen from the electrolysis process as at least a part of the gaseous oxygen for direct smelting iron ore in the direct smelter.

The invention also provides an apparatus for producing iron that includes:

(a) a direct smelter for producing molten iron and an off-gas containing $CO_2$, and
(b) the above-described electrolysis apparatus for producing solid carbon and gaseous oxygen from $CO_2$ produced in the direct smelter, and
(c) equipment for transferring solid carbon produced in the electrolysis apparatus to the direct smelter.

The apparatus may include equipment for transferring gaseous oxygen produced in the electrolysis apparatus to the direct smelter.

The invention also provides a process for producing iron that includes: producing solid carbon and gaseous oxygen in accordance with the above-described electrolysis process, producing molten iron and an off-gas containing $CO_2$ in a blast furnace, with $CO_2$ in the off-gas from the blast furnace being used in the electrolysis process, and with solid carbon produced in the electrolysis process being used as a carbon source for the blast furnace.

The process may include mixing solid carbon from the electrolysis process and a binder, such as bio-oil or tar, and forming lumps of solid carbon, processing the lumps to coke, and supplying the coke to the blast furnace.

The process may include supplying solid carbon from the electrolysis process to the blast furnace, for example, as a substitute for pulverised coal injection into the blast furnace.

The process may include using gaseous oxygen from the electrolysis process in the blast furnace.

The invention also provides an apparatus for producing iron that includes:

(a) a blast furnace for producing molten iron and an off-gas containing $CO_2$, and
(b) the above-described electrolysis apparatus for producing solid carbon and gaseous oxygen from $CO_2$ produced in the blast furnace, and
(c) equipment for processing solid carbon produced in the electrolysis apparatus for use as a feed material in the blast furnace.

The apparatus may include equipment for transferring gaseous oxygen produced in the electrolysis apparatus to the blast furnace.

The invention also provides a process and an apparatus for producing steel that includes converting iron produced as described above into steel.

The process may include using gaseous oxygen from the electrolysis process in a steelmaking vessel, such as a BOF.

BRIEF DESCRIPTION OF THE DRAWINGS

The present invention is described further by way of example only with reference to the accompanying drawings, of which:

FIG. 1 is a schematic diagram of an embodiment of the electrolysis apparatus of the invention that includes an electrolysis cell with single electrode pair and a solid anode (Embodiment A);

FIG. 2 is a schematic diagram of another embodiment of the electrolysis apparatus of the invention that includes an electrolysis cell with single electrode pair and an anode featuring apertures for oxygen bubble escape (Embodiment B);

FIG. 3 is a schematic diagram of another embodiment of the electrolysis apparatus of the invention that includes an electrolysis cell with multiple electrode pairs, each with a solid anode (Embodiment C);

FIG. 4 is a schematic diagram of another embodiment of the electrolysis apparatus of the invention that includes an electrolysis cell with multiple electrode pairs and anodes featuring apertures for oxygen bubble escape (Embodiment D);

FIG. 5 is a schematic diagram of another, although not the only other possible, embodiment of the electrolysis apparatus of the invention that includes an electrolysis cell with a vertically oriented electrode pair and a cathode having a porous medium;

FIG. 6 is a schematic diagram of an embodiment of a process and apparatus for producing iron using an HiSarna™ direct smelting unit in accordance with the invention;

FIG. 7 is a schematic diagram of an embodiment of a process and apparatus for producing iron using a blast furnace in accordance with the invention;

FIG. 12 shows the current density curves for the electrolysis using a solution of 10 wt % PEI+90 wt % water and 0.1M $NH_4BF_4$ during laboratory work carried out by the applicant;

DESCRIPTION OF EMBODIMENTS AND EXPERIMENTAL WORK

Figure 9:
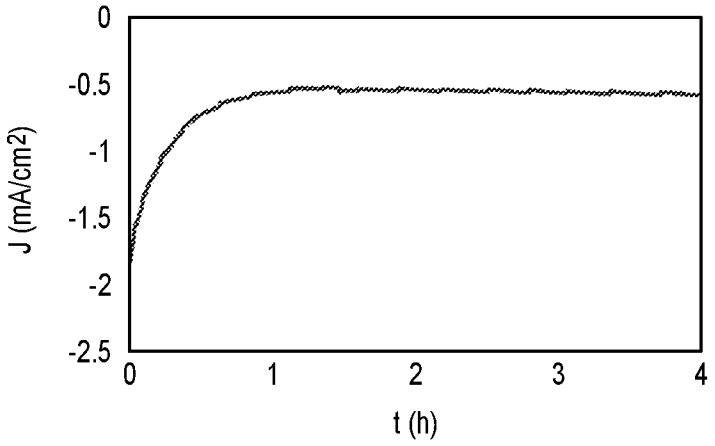
FIG. 9 is a current density curve for the electrolysis using a solution of 66 wt % MEA+34 wt % water and 0.1M $NH_4BF_4$ during laboratory work carried out by the applicant.

The present invention comprises an electrolysis process and apparatus for reducing $CO_2$ via electrolysis at an industrial scale and producing solid carbon and gaseous oxygen.

The present invention is described below in relation to a number of, although not the only, embodiments of the invention and experimental work in relation to aspects of the invention.

Overview of the Embodiments of FIGS. 1-5

In some embodiments, for example as described in relation to FIGS. 1-4, the electrolysis apparatus has one or more pairs of generally horizontally oriented cathode and anode plates, with the angle relative to the horizontal being less than 10 degrees. Each upward-facing cathode plate shown in the Figures has a generally non-conducting base and an upstanding perimeter wall that forms a tray which contains a static pool of liquid metal, as described herein, with a depth in the range 1-50 mm. The metal pool is electrically connected to the cathode and effectively becomes part of the cathode. The anode is positioned above the cathode as a parallel plate, with distance between the top of the liquid metal and the bottom of anode plate in the range 10-100 mm. The cathode and the anode are appropriately insulated from earth and connected to a direct current power source. The cathode potential is negative 1 to 4 V with reference to an Ag/Ag+(10 mM AgNO3 in acetonitrile) electrode. Under these conditions, in use, the electrolyte is supplied to the chamber via the inlet and is discharged from the chamber via the outlet. The electrolyte flows from the inlet to the outlet in fluid communication with the cathode-anode pair. The voltage applied between the cathode-anode pair causes solid carbon to form on the cathode from $CO_2$ in the electrolyte and gaseous oxygen to be evolved at the anode from $CO_2$ in the electrolyte. Solid carbon is discharged by being transported from the cathode in the electrolyte to the electrolyte outlet and from the chamber via the outlet. Gaseous oxygen is discharged from the chamber via a gas outlet.

In other embodiments, for example as described in relation to FIG. 5, the cathode includes a vertically arranged flow-restricting element in the form of a porous medium across or through which the liquid metal, as described herein, percolates slowly under gravity. The porous medium is selected such that a more or less continuous liquid metal surface is presented to the electrolyte, whilst at the same time slowing gravity-induced downward flow such that the integrity of the liquid metal interface with the electrolyte is preserved. Using this type of porous medium allows the orientation of the cell to depart dramatically from horizontal, up to vertical. Under these conditions, in use, liquid metal passes through the porous medium, flowing under gravity from the top to the bottom. In order to maintain such a system, liquid metal that exits the porous element at the bottom is collected and returned to the top in such a way that, in use, the top region maintains a more or less continuous liquid metal-electrolyte interface at all times.

The described embodiments of FIGS. 1-5 operate at a temperature in the range 0 to 200° C., and pressure in the range ambient to 50 bar g. The liquid metal may be any suitable metal-containing substance that is substantially liquid at the operating temperature of the cell and is capable of catalysing reduction of $CO_2$ to solid carbon under the operating conditions. The liquid metal may include an active agent for catalysing carbon dioxide reduction, such as Ce or any other suitable substance.

In the described embodiments of FIGS. 1-5, the electrolyte is a liquid at cell operating temperature with a relatively high capacity for holding dissolved carbon dioxide in solution. Water will be present in this electrolyte since this is an essential part of the reaction sequence for the embodiments.

The selection of an electrolyte will depend on a number of factors, including pressure—if the cell is to operate at the lower end of the range, then it could be advantageous to use a solvent such as dimethylformamide because this will significantly increase the mole fraction of dissolved carbon dioxide. At the higher end of the pressure range it may become advantageous to use water alone, since carbon dioxide solubility increases under these conditions.

In the described embodiments of FIGS. 1-5, the electrolyte flows in a closed loop. It will be loaded with carbon dioxide in a saturator vessel to bring it close to saturation. This loaded electrolyte will then be pumped into the main electrolyser cell and will pass between the cathode and anode plates. The superficial velocity of the electrolyte in the liquid metal-to-anode gap will be in the range 0.05-5 m/s. Solid carbon flakes will be generated at the interface between the liquid metal and the electrolyte, while oxygen bubbles will be generated at the anode plate.

In the described embodiments of FIGS. 1-5, the reaction products (solid carbon and gaseous oxygen) are managed in such a way that they do not interfere with ongoing electrolysis.

Typically, the solid carbon will be in the form of flakes. Carbon flakes adhere only very weakly (if at all) to the liquid metal surface, so electrolyte flow (depending on velocity) may be sufficient to dislodge carbon and allow removal by simple convection. If adherence becomes more of an issue, techniques such as ultrasonic agitation or physical wave generation on the surface of the liquid metal (by mechanical or other means) may be used.

Oxygen bubbles collecting at the underside of the anode could compromise electrical conductivity and slow the reaction if their volume fraction becomes too high. Simple convection of the electrolyte may be sufficient to manage this but, if not, appropriate apertures in the anode (holes or slots) may be provided to allow upward escape of oxygen bubbles. In the "flat metal pool" embodiments of FIGS. 1-4 the anode may also be angled to a modest degree (relative to the cathode) to further promote oxygen bubble removal, either in discrete stages (with individual gas outlets) or as a whole. In the "porous cathode medium" embodiment of FIG. 5, any angle may be used, with oxygen bubbles (most likely) rising counter-current to the flow of electrolyte. It should also be noted that operating pressure will have a significant impact on the volume of oxygen bubbles in the system, with higher pressures leading to reduced bubble volumes.

In the described embodiments of FIGS. 1-5, as electrolyte approaches the electrolyte outlets, it is carbon dioxide-depleted and contains both carbon flakes and (at least some) oxygen bubbles. A gas-liquid separation stage allows oxygens to leave the system without carrying significant electrolyte with it. At the liquid outlet, a carbon filtering system removes product carbon from the electrolyte. This carbon filtration system may be any suitable system for removing substantially all the solid carbon from the electrolyte whilst maintaining the electrolyte in the liquid phase. From here depleted electrolyte will be sent to the saturator to complete the cycle.

The described embodiments of FIGS. 3 and 4 include a stack of several anode/cathode pairs of electrodes within a common electrolyte bath for cost and efficiency reasons. In the case of a solid anode, this is accomplished by providing a layer of insulating material on the top surface of the anode and placing a second cathode-anode assembly on top (and so forth). If the anode is not solid (viz contains apertures for progressive upward escape of oxygen bubbles) then each cathode-anode assembly needs its own oxygen collection chamber at the top of the anode. Multi-stack assemblies are still possible with insulating layers between each cathode-anode pair, but in this case each oxygen offtake chamber will need a two-phase flow control device at the outlet in order to maintain reasonable fluid mechanics. This controller may be any suitable device, including a vertical lift column with re-injection of product oxygen gas (at a controlled rate) in order to manage suction pressure drop.

It is not necessary to circulate liquid metal at all in the described embodiments of FIGS. 1-4.

When the liquid metal includes catalysts such as Ce, the catalyst can regenerate itself locally, its working redox cycle can take place within a small local zone close to the metal-electrolyte interface. However, this does not mean that periodic (partial) liquid metal change-out is undesirable. It may be advantageous to replace a portion of the liquid metal inventory on a regular cycle (perhaps once a day) in order to clean and re-activate it by replacing or supplementing catalytically active ingredients before it is returned to service. In addition, the described embodiment of FIG. 5 includes liquid metal circulation.

In the described embodiments of FIGS. 1-5, the electrolyte containing dissolved $CO_2$ is pumped into the chamber via the electrolyte inlet. Typically, the electrolyte will contain water and may or may not include another solute such as dimethylformamide (depending on pressure). As the electrolyte passes through the cell it becomes depleted in $CO_2$ and will eventually be pumped out via the electrolyte outlet, carry solid carbon. The electrolyte is then re-loaded with $CO_2$ before being pumped back to the electrolyte inlet.

This re-loading step involves dissolving $CO_2$ gas into the electrolyte. One option for doing this is disclosed in WO 94/01210 in the name of Technological Resources Pty Ltd (12). WO 94/01210 describes a method for efficiently creating small gas bubbles in a high pressure liquid body by use of venturi aspirators. Although there are several ways to promote gas dissolution into liquids, this option is considered particularly well suited and is a strong candidate for electrolyte re-loading with carbon dioxide. The disclosure in WO 94/01210 is incorporated herein by cross-reference.

FIG. 1 Embodiment

FIG. 1 is a schematic diagram of Embodiment A of a process and an apparatus for electrolysis of carbon dioxide into solid carbon and gaseous oxygen according to the invention.

With reference to FIG. 1, the apparatus includes an electrolysis chamber 101 and a $CO_2$ saturator 102. Carbon dioxide 103 is dissolved in the electrolyte in saturator 102 via a venturi aspirator which forms part of saturator 102. Loaded electrolyte 105 containing substantial dissolved carbon dioxide is fed into electrolysis chamber 101 via electrolyte pump 104.

Inside chamber 101 a pool of electrolyte 106 is maintained, with an oxygen-rich gas space 107 above. Cathode 108 comprises a large horizontal solid plate with a fully surrounding weir constructed from non-conducting material 109 on its upper face. A liquid metal pool 110 with a depth of 5-10 mm is maintained on the upper face of the cathode, in direct electrical contact with cathode 108.

Anode 111 comprises a parallel flat plate set 30-80 mm above the surface of liquid metal 110. Power supply 112 is connected to the cathode-anode pair to maintain a voltage in the range 1 to 10 volts, typically 2-6 volts, more typically 2-4 volts.

In use, loaded electrolyte 105 is pumped from left to right as shown, at a superficial liquid velocity in a gap between liquid metal 110 and the bottom of anode 111 in a range 0.1-1 m/s.

Both oxygen bubbles 113 and carbon flakes 114 are transported to the right by electrolyte convection. As they leave the cathode-anode gap (at right hand extreme), oxygen bubbles rise into gas space 107 and from there pass through demister 115 where any residual electrolyte is removed and returned to cell 101. Final oxygen product 116 is removed for compression and re-use or else is vented.

Electrolyte containing carbon flakes 117 enter filter 118 where solid carbon is removed. Carbon product 119 is collected and removed for storage or re-use.

FIG. 2 Embodiment

FIG. 2 is a schematic diagram of Embodiment B of a process and an apparatus for electrolysis of carbon dioxide into solid carbon and gaseous oxygen according to the current invention.

With reference to FIG. 2, all numerals have been incremented by 100 and otherwise have the same meaning as those in FIG. 1, apart from anode 211 and oxygen bubbles 213.

In FIG. 2, anode 211 contains apertures that allow progressive release of oxygen bubbles 213 upwards and away from the reaction zone. If conditions in the electrolyser with Embodiment A (FIG. 4) are such that there is a large gas fraction trapped under the anode and this compromises anode efficiency, then the Embodiment B (FIG. 1) becomes a more preferred embodiment.

FIG. 3 Embodiment

FIG. 3 is a schematic diagram of Embodiment C of a process and an apparatus for electrolysis of carbon dioxide into solid carbon and gaseous oxygen according to the current invention.

With reference to FIG. 3, the general layout and operation of components is the same as that in Embodiment A (FIG. 1) apart from electrode arrangements.

FIG. 3 shows 6 electrode pairs stacked on top of one another in a common electrolyte pool. Insulation layer 320 separates each pair of electrodes, allowing each pair to operate without electrical interference from the pair above or the one below.

If current densities for the arrangement in Embodiment A (FIG. 1) are too low for acceptable economics, then a stacked arrangement such as Embodiment C (FIG. 3) is an option for improving cost efficiency.

FIG. 4 Embodiment

FIG. 4 is a schematic diagram of Embodiment D of a process and an apparatus for electrolysis of carbon dioxide into solid carbon and gaseous oxygen according to the current invention.

With reference to FIG. 4, the general layout and operation of components of this embodiment are the same as that in Embodiment C (FIG. 3) apart from anode 411, oxygen bubbles 413 and flow control devices 421.

In this case, electrode pairs are again stacked on top of one another as in Embodiment C. The key difference is that each anode 411 has apertures for progressive oxygen bubble release, together with an individual oxygen collection chamber 413 and a flow controller 421. As with Embodiment B, this variant will be preferred if the gas fraction immediately below each anode becomes too high to support efficient operation.

Each oxygen collection chamber 413 will have both electrolyte and gas flowing through inside it. This involves reasonably complex two-phase flow which will need to be controlled carefully. Pressure drop across each individual oxygen chamber will need to be roughly the same (as those of other chambers) despite the difference in liquid head from the chamber outlet to the head-space of electrolysis chamber 401. It will therefore be necessary to provide each oxygen chamber 413 with its own flow restrictor or control device for this purpose.

FIG. 5 Embodiment

FIG. 5 is a schematic diagram of an electrolysis cell with a vertically oriented electrode pair utilising a cathode involving flow-restricting element in the form of a porous medium 509.

The primary difference relative to the embodiment D of FIG. 4 is that, instead of a more or less static liquid pool of metal, this embodiment has the flow restricting element in the form of a porous medium 509 connected to the cathode.

The porous medium (and other suitable options for flow restricting element) allows liquid metal to percolate slowly downwards in such a way that a more or less continuous metal surface is presented to the electrolyte. Metal that has percolated through the porous medium 509 is collected in a chamber 510 and returned to the top of the porous element in order to retain cathode interface integrity.

An advantage of this arrangement is that oxygen bubbles will rise under gravity and be easier to remove. It is also possible to arrange such a system at an angle other than vertical to assist further with oxygen bubble removal.

Overview of the Embodiments of FIGS. 6 and 7

FIGS. 6 and 7 show embodiments of an iron making process and apparatus in accordance with the invention that include the electrolysis process/apparatus of the invention, for example the embodiments shown in FIGS. 1-5.

FIG. 6 Embodiment

A conventional HIsarna™ direct smelting process uses technical-grade oxygen, fine coal and BF-quality iron ore fines. It produces hot metal plus an off-gas with >90% $CO_2$; from here it is relatively easy to get to pure $CO_2$. The electrolysis process/apparatus of the invention, for example the embodiments shown in FIGS. 1-5, closes the loop by reacting the $CO_2$ back into carbon and technical-grade oxygen.

FIG. 6 shows a green steel application of the electrolysis process/apparatus of the invention, for example the embodiments shown in FIGS. 1-5, and a HIsarna™ direct smelting unit for producing molten iron.

HIsarna™ smelter 601 converts iron ore 602 and recovers carbon fines from storage 607 directly into hot metal 603 and $CO_2$-rich off-gas. This off-gas is then compressed and cooled (with removal of non-condensable gas species) prior to being stored as a liquid in tanks 708. When intermittent green power 606 becomes available, electrolysis apparatus 605 (for example, one of the embodiments of FIGS. 1-5) starts up and converts $CO_2$ into oxygen 608 and solid carbon 609.

The amount of carbon needed in the HIsarna™ plant, exceeds the amount recovered from $CO_2$ when hot metal 603 contains around 4% carbon. This carbon deficit can be made up in a number of ways, including by feeding another source of non-fossil carbon (e.g. dried biomass) into HIsarna™ plant 601.

FIG. 7 Embodiment

The embodiment of a process and an apparatus for producing molten iron show in FIG. 7 is based on the use of a blast furnace.

A key difference relative to direct smelting process/apparatus shown in FIG. 6 is that solid coke lumps are needed in the blast furnace in order to maintain shaft porosity. This requires conversion of at least a portion of recovered carbon for the electrolysis process/apparatus into lumps with suitable strength, using a binding agent such as bio-oil, tar or other suitable material.

Blast furnace 701 converts iron ore 702 and synthetic coke from coke ovens 712 into hot metal 703. Top gas from blast furnace 701 is captured in $CO_2$ scrubber 701*a*, and from there is sent to $CO_2$ tank storage 704. When intermittent green power 706 becomes available, electrolysis apparatus 705 starts up and converts $CO_2$ into oxygen 708 and solid carbon 709.

Some fine carbon from storage 709 may be used as a substitute for pulverised coal injection (PCI) in blast furnace 701, but at least a portion needs to be formed into lumps in briquette plant 710 using a binding agent such as bio-oil, tar or other suitable medium 711. Green briquettes can then be converted into synthetic coke in coke plant 712 before being returned to blast furnace 701.

Many modifications may be made to the embodiments described in relation to FIGS. 1-7 without departing form the spirit and scope of the invention.

By way of example, whilst the cathode of the embodiment shown in FIG. 5 includes a flow-restricting element in the form of a porous medium, the invention is not so limited and extends to any suitable flow-restricting element that is formed and positioned in the chamber so that the liquid metal can percolate, typically slowly, under gravity through the flow-restricting element from an upper inlet to a lower outlet. Other examples of the flow-restricting element include mesh-based elements or solid elements having a series of surface features that cause a flow restriction.

By way of example, whilst the embodiments of the electrolysis process and apparatus shown in FIGS. 1-5 are described with reference to applications in ironmaking and steelmaking in the embodiments shown in FIGS. 6 and 7, the invention is not so limited, and the electrolysis process and apparatus of the invention can be used in other applications, such as:

(i) Centralised (for example, fossil fuel-derived) $CO_2$ collection with buffer storage, in conjunction with the electrolyser and the electrolytic process of the invention, for example, using intermittent renewable power, and carbon product disposal in disused mines or other applications.

(ii) Remote $CO_2$ removal from air (for example, based on renewable energy), coupled with the electrolyser and the electrolytic process of the invention and carbon product disposal in disused mines or other applications.

(iii) Carbon dioxide recirculation systems for applications requiring such systems, such as nuclear submarines.

Summary of Experimental Work

Experimental work in relation to the present invention was carried out by the applicant, including the Department of Chemical Engineering at the University of Melbourne, Melbourne, Victoria.

The purpose of the experimental work was to demonstrate that the invention can produce solid carbon and $O_2$ gas from $CO_2$ via electrolysis with a liquid electrolyte containing $CO_2$ in solution and a cathode-anode pair, with the cathode being in the form of a liquid metal as defined herein capable of catalysing reduction of $CO_2$ to solid carbon, without the cathode fouling over time.

The experimental work included but was not limited to the experimental work summarised below:

The experimental work was conducted on a small-scale batch basis.

Electrolysis of $CO_2$ with a liquid metal cathode (cerium-containing Galinstan) and different electrolyte solutions in an electrolysis apparatus.

Figure 8:
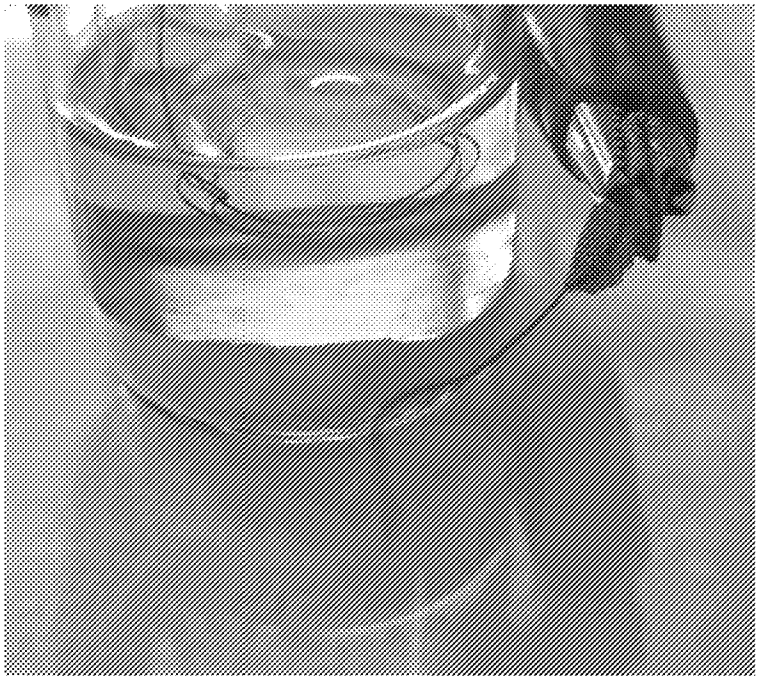
FIG. 8 is an image of the setup of the electrolysis apparatus during laboratory work carried out by the applicant.

The electrolysis apparatus was set up as a beaker with the liquid metal cathode and a metal wire anode connected to a power supply, as shown in FIG. 8.

The electrolysis apparatus included a Ag/AgCl reference electrode (RE), 3M KCl as a reference electrolyte, and an applied voltage of −0.120V vs. Normal Hydrogen Electrode (NHE).

The liquid metal cathode formed a layer at the bottom of the beaker.

In some embodiments of the experiment, smaller amounts of liquid metal forming a flattened droplet or "marble" of liquid metal were used in place of the liquid metal layer (in order to preserve reagent materials).

The electrolyte formed a top layer above the layer (or marble) of liquid metal.

A number of different electrolytes were tested.

The electrolytes included solutions of organic solvents (such as MEA or polyethylenimine (PEI) or DMF), electrolyte salts (such as $NH_4BF_4$), and other $CO_2$ absorbing agents.

Experimental Results—Summary

Solid carbon and $O_2$ were produced in each experiment described below.

The reaction rate for solid carbon generation using electrolytes containing amines (such as MEA or PEI) was several orders of magnitude greater than published experimental work carried out without a $CO_2$ absorbing agent (7).

The current density results indicate that the liquid metal cathode did not foul during the duration of the experiments.

The current densities in the experiments were low but explicable and not a concern.

The current densities were calculated based on the surface areas of the liquid metal cathodes, which is significantly larger than the surface areas of the anode wires.

Experiment 1

A solution of 66 wt. % MEA+34 wt. % water and 0.1M $NH_4BF_4$ was used as the electrolyte in the electrolysis of $CO_2$ to produce solid carbon.

Galinstan was used as the liquid metal cathode.

$CO_2$ was injected in the solution before electrolysis.

The applied voltage was −1.5V vs. RE.

The current density (j) curve is shown in FIG. 9. The Figure shows that the current density decreased quickly from the start of the experiment to a value of 0.5 $mA/cm^2$ and remained substantially constant for the remainder of the duration of the experiment. This substantially constant current density is an indication that the liquid metal cathode did not foul during the duration of the experiment.

Figure 10:
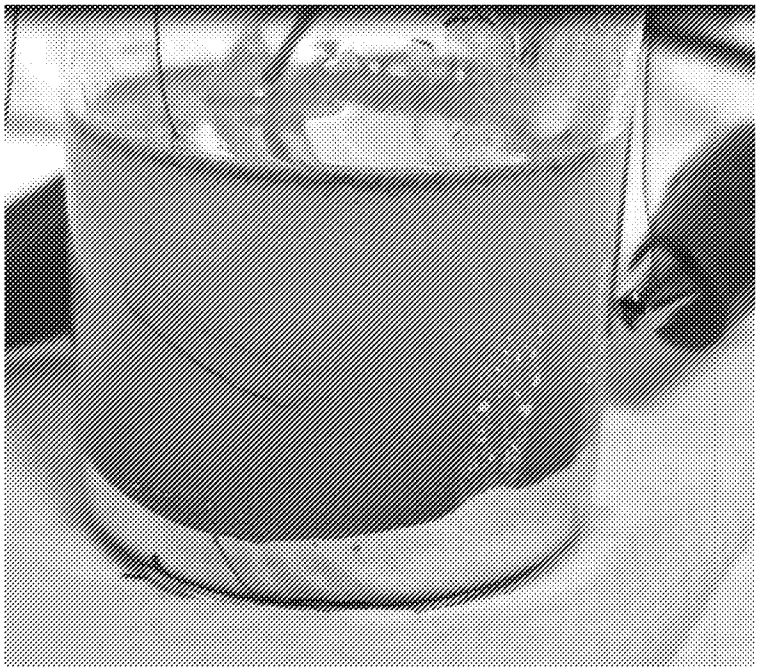
FIG. 10 is an image of the electrolysis apparatus after the electrolysis reaction using a solution of 66 wt % MEA+34 wt % water and 0.1M $NH_4BF_4$ during laboratory work carried out by the applicant.

The image of the apparatus after the electrolysis reaction is shown in FIG. 10. It is evident from the Figure that solid carbon was produced. This is evident from the solution colour with small carbon particles dispersed in the solution and small carbon particles on the surface.

Figure 11:
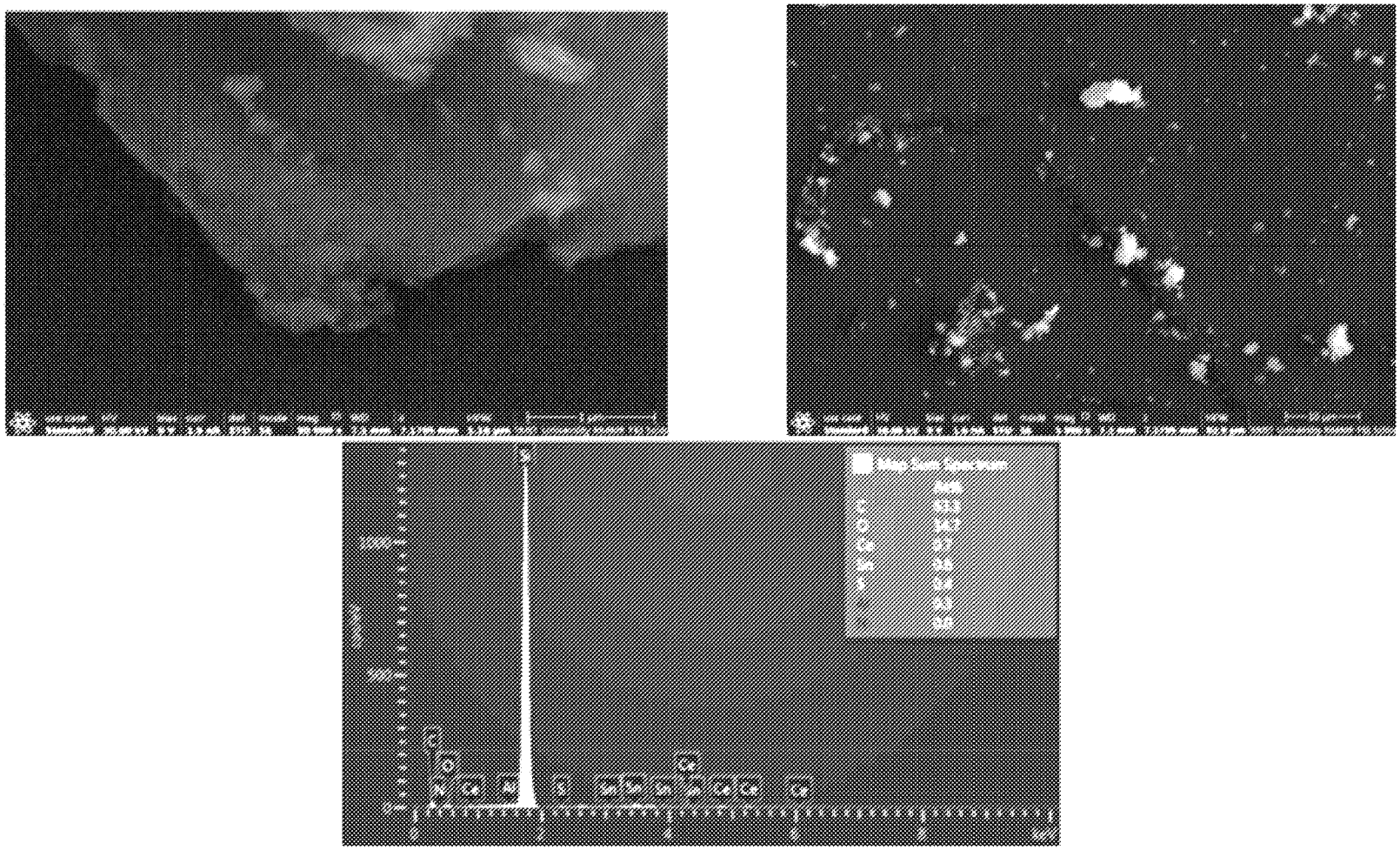
FIG. 11 is a SEM image and EDS spectrum of the solid carbon produced by the electrolysis reaction using a solution of 66 wt % MEA+34 wt % water and 0.1M $NH_4BF_4$ during laboratory work carried out by the applicant.

The surfaces of solids in the beaker were viewed in a SEM and elemental analysis of samples were performed using EDS, with the results are shown in FIG. 11. The 2 SEM images in the Figure show the solid carbon. The EDS results in the Figure shows that the solids contained 63.3 wt. % carbon.

Experiment 2

A solution of 10 wt. % PEI+90 wt. % water and 0.1M $NH_44BF_4$ was used as the electrolyte in the electrolysis of $CO_2$ to produce solid carbon.

Galinstan was used as the liquid metal cathode.

$CO_2$ was injected in the solution before electrolysis.

The applied voltage was −1.2V vs. RE.

The current density curves are shown in FIG. 12. There are two curves. The left-hand curve shows that the current density decreased linearly until it reached a value of 0 $mA/cm^2$ as the voltage was decreased from −3V vs RE to −1.2V vs. RE. The current density remained constant as the voltage was decreased from −1.2V vs. RE to −0.6V vs RE. The right-hand curve shows that the current density decreased quickly to a value of 0.4 $mA/cm^2$ and slowly increased for the remainder of the duration of the experiment.

Figure 13:
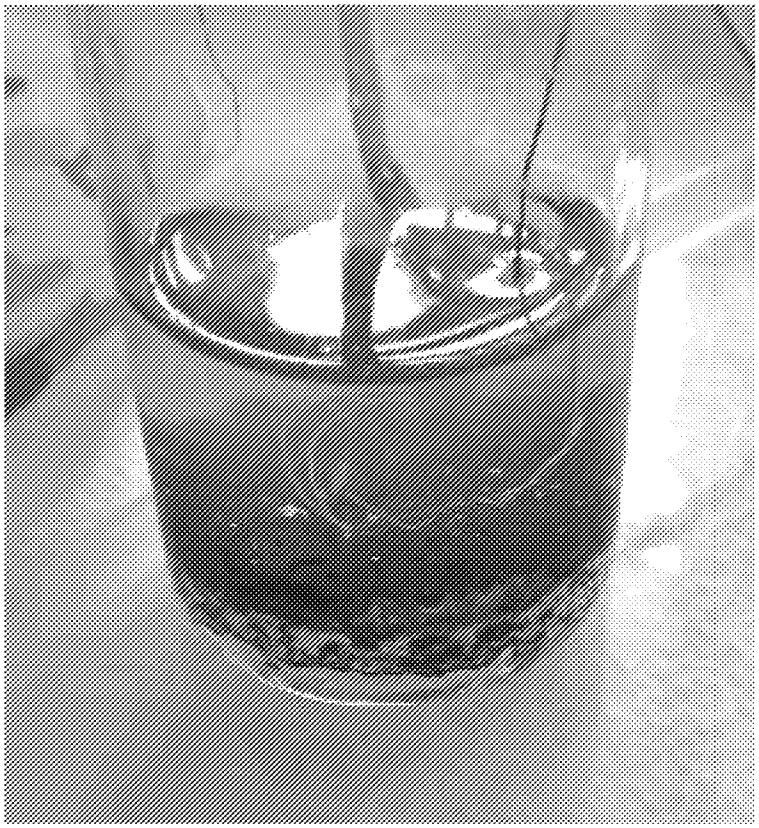
FIG. 13 is an image of the electrolysis apparatus after the electrolysis reaction using a solution of 10 wt % PEI+90 wt % water and 0.1M $NH_4BF_4$ during laboratory work carried out by the applicant.

The image of the apparatus after the electrolysis reaction is shown in FIG. 13. It is evident from the Figure that solid carbon was produced. This is evident from the solution and colour and large carbon flakes in a lower section of the beaker.

Experiment 3

A solution of pure MEA and 0.1M $NH_4BF_4$+2.5M $H_2O$ was used as the electrolyte for the electrolysis of $CO_2$ to produce solid carbon.

Galinstan was used as the liquid metal cathode.

The solution was left in air and no $CO_2$ was injected in the solution before electrolysis.

The applied voltage was −1.4V vs. RE.

Figure 14:
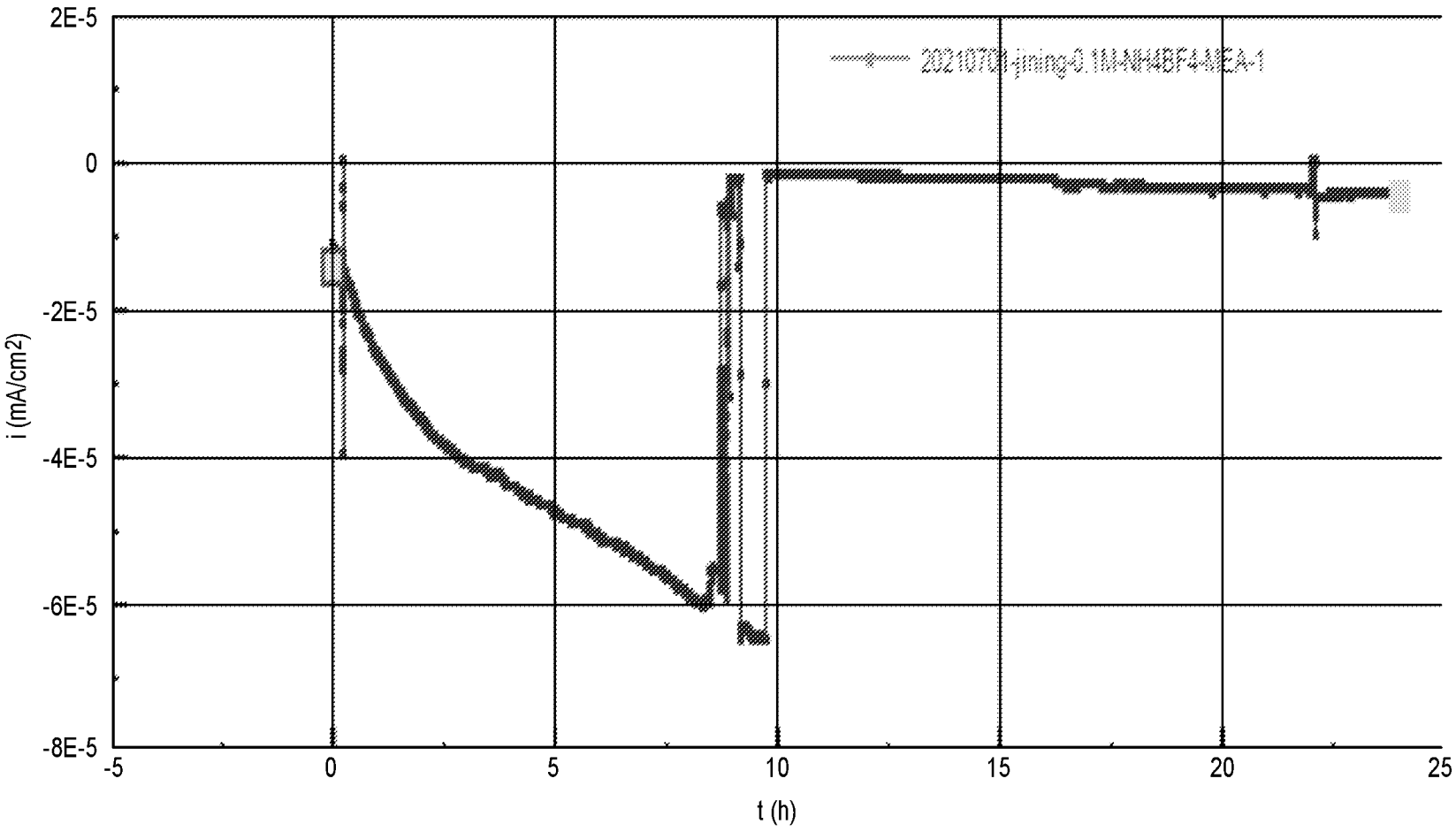
FIG. 14 is a current density curve for the electrolysis using a solution of pure MEA and 0.1M $NH_4BF_4$+2.5M $H_2O$ during laboratory work carried out by the applicant.

The current density curve is shown in FIG. 14. The Figure shows that the current density increased quickly for an initial time period, then decreased very quickly and then remained substantially constant for the remainder of the duration of the experiment. This substantially constant current density is an indication that the liquid metal cathode did not foul during the duration of the experiment.

Figure 15:
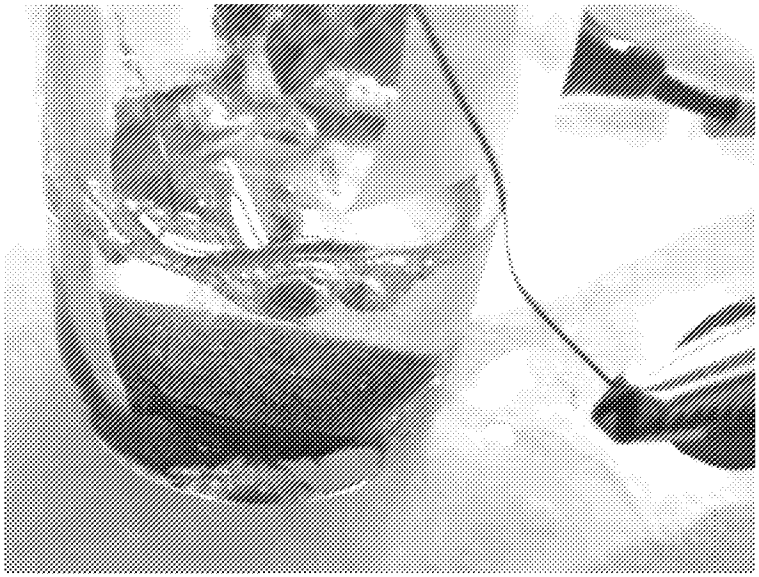
FIG. 15 is an image of the electrolysis apparatus after the electrolysis reaction using a solution of pure MEA and 0.1M NH4BF4+2.5M $H_2O$ during laboratory work carried out by the applicant.

The image of the apparatus after the electrolysis reaction is shown in FIG. 15. It is evident from the Figure that solid carbon was produced. The solid carbon is in a lower section of the beaker.

Experiment 4

Solutions of 5 different concentrations of DMF+MEA and 0.05M $NH_4BF_4$+1M $H_2O$ were used as electrolytes for the electrolysis of $CO_2$ to produce solid carbon.

Galinstan was used as the liquid metal cathode.

$Co_2$ was injected in the solution before electrolysis.

The applied voltage was −2.0V vs. RE.

Figure 16:
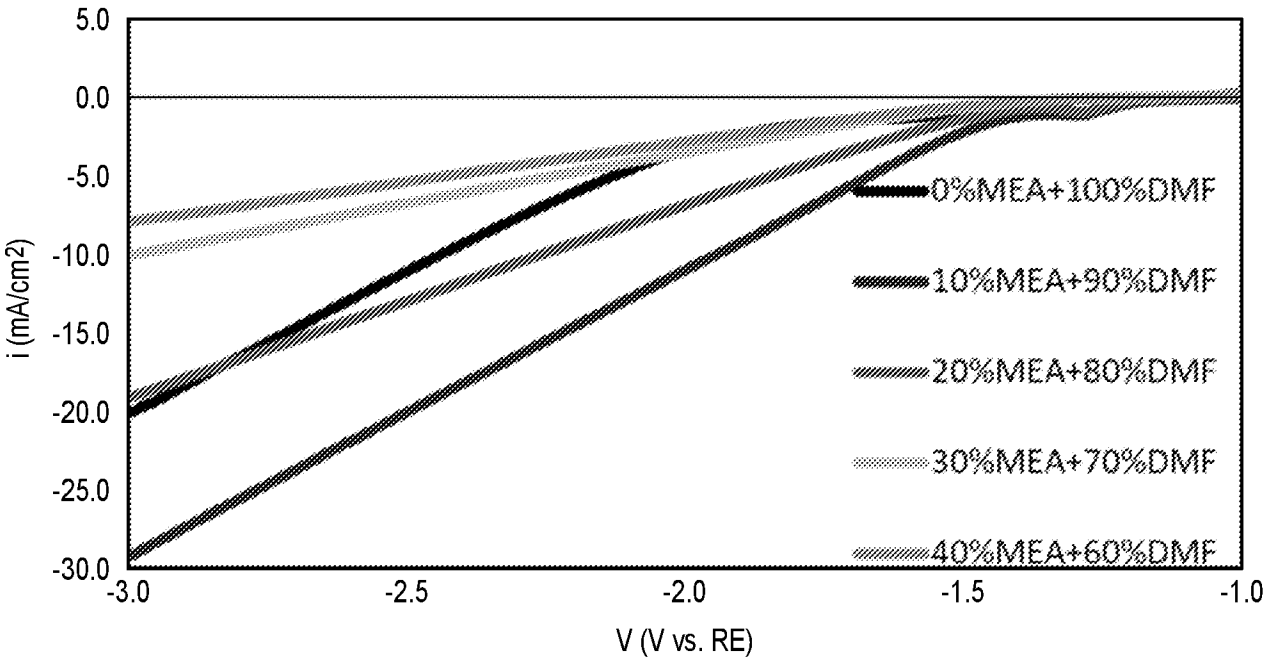
FIG. 16 shows the current density curves for the electrolysis using electrolytes having different concentrations of DMF+MEA+0.05M $NH_4BF_4$+1M $H_2O$ during laboratory work carried out by the applicant.

The current density curves are shown in FIG. 16. The Figure shows that increasing proportions of MEA in the combinations of DMF+MEA in the electrolytes had an impact on the current density. For all the different concentrations of MEA in the electrolyte solution, the current densities decreased linearly until a value of 0 mA/cm$^2$ as voltage was decreased from −3.0V vs RE to −1.0V vs RE.

Figure 17:
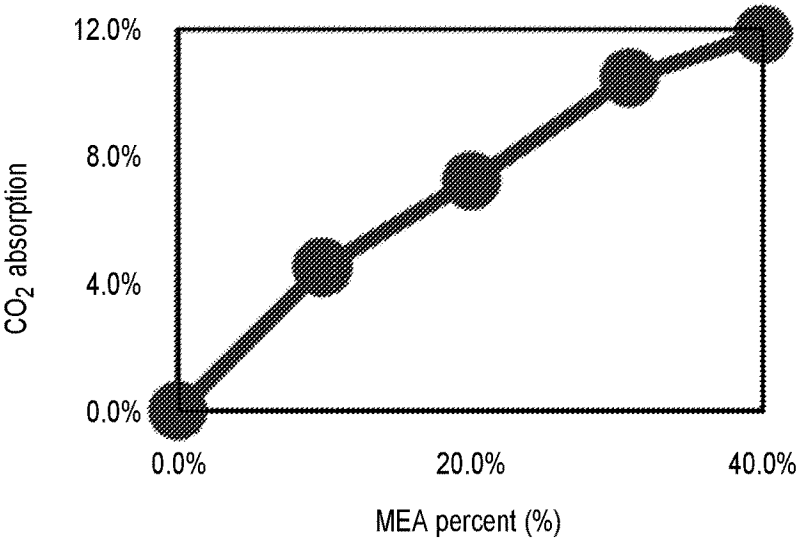
FIG. 17 is a $CO_2$ absorption curve for different concentrations of MEA in the solution in the electrolysis using electrolytes having different concentrations of DMF+MEA+0.05M $NH_4BF_4$+1M $H_2O$ during laboratory work carried out by the applicant.

FIG. 17 shows the relationship between the $CO_2$ absorption for different concentrations of MEA in the electrolyte solution is shown in FIG. 17. In particular, the Figure shows that the $CO_2$ absorption increased with increasing MEA as a percentage of DMF+MEA.

Figure 18:
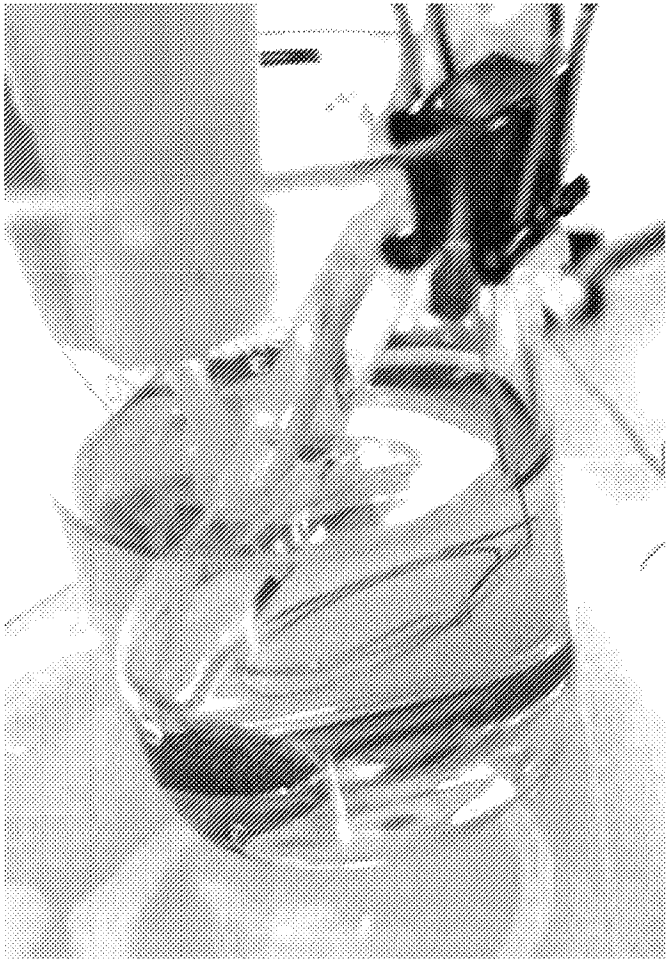
FIG. 18 is an image of the electrolysis apparatus after the electrolysis reaction using a solution of DMF+MEA+0.05M $NH_4BF_4$+1M $H_2O$ during laboratory work carried out by the applicant.

The image of the apparatus after the electrolysis reaction for one of the experiments is shown in FIG. 18. It is evident from the Figure that solid carbon was produced. The solid carbon is in a lower section of the beaker.

Whilst the experimental work was conducted in a beaker at a small-scale and not carried out in a full-scale equipment, the applicant believes that the same or similar results would be obtained if carried out on a larger scale.

Modeling carried out by the applicant indicates that the experimental data for the electrolytes tested can be extrapolated to other electrolytes.

Moreover, whilst the experimental work was carried out on a small-scale batch basis, the applicant expects that the results are equally applicable to the embodiments of the electrolysis apparatus of the invention shown in FIGS. 1-5, noting that the purpose of the experimental work was to demonstrate that the invention can produce solid carbon and $O_2$ gas from $CO_2$ via electrolysis with a liquid electrolyte containing $CO_2$ in solution and a cathode-anode pair, with the cathode being in the form of a liquid metal as defined herein capable of catalysing reduction of CO to solid carbon, without the cathode fouling over time.

REFERENCES

1. IEA Renewables 2020 Fuel Report (November 2020) Hyperlink: https://www.ica.org/reports/renewables-2020?utm_campaign=IEA%20 newsletters&utm_source=SendGrid&utm_medium=Email

2. SEI, 2019. Hydrogen Breakthrough Ironmaking Technology (HYBRIT) is a ground-breaking effort to reduce $CO_2$ emissions and de-carbonise the steel industry. Hyperlink: https://www.sei.org/projects-and-tools/projects/hybrit/

3. Hydrogen Storage, Wikipedia Hyperlink: https://en.wikipedia.org/wiki/Hydrogen_storage

4. J Kaczur et al, Process for High Surface Area Electrodes for the Electrochemical reduction of carbon Dioxide, U.S. Pat. No. 8,858,777 B2, Oct. 14, 2014 (Liquid Light Inc, NJ)

5. C A Oloman and H Li, Continuous Electrochemical Reduction of Carbon Dioxide, Canadian patent 2,625, 656, October 2006 (Mantra Energy Alternatives, CA)

6. N B Jakobsson et al, Process for Producing CO from $CO_2$ in a Solid Oxide Electrolysis Cell, U.S. Pat. No. 10,494, 728 B2, December 2019 (Haldor Topsoe)

7. Esrafilzadeh, 2019. Esrafilzadeh et al. Room temperature $CO_2$ reduction to solid carbon species on liquid metals featuring atomically thin ceria interfaces. Nature Communications (2019) 10:8665. https://www.nature.com/articles/s41467-019-08824-8

8. M J Dry and R J Dry, Steel from Uranium?, Uranium 2020 Conference (Virtual), 14-15 Oct. 2020

9. O'Brien, Thomas F.; Bommaraju, Tilak V.; Hine, Fumio (2005), O'Brien, Thomas F.; Bommaraju, Tilak V.; Hine, Fumio (eds.), "History of the Chlor-Alkali Industry", Handbook of Chlor-Alkali Technology: Volume I: Fundamentals, Volume II: Brine Treatment and Cell Operation, Volume III: Facility Design and Product Handling, Volume IV: Plant Commissioning and Support Systems, Volume V: Corrosion, Environmental Issues, and Future Development, Boston, MA: Springer US, pp. 17-36, doi:10.1007/0-306-48624-5_2, ISBN 978-0-306-48624-1, retrieved 2020-10-05

10. A L Barbato et al, Inclined Mercury Cell and Method of Operation, U.S. Pat. No. 3,308,044, March 1967 (Oronzio de Nora Impianti-Elettrochimci, Milan, Italy)

11. Greener Industry UK http://www.greener-industry-.org.uk/pages/chlorine/6chlorine_PM1.htm

12. R J Batterham et al, A Reactor, WO 94/01210, January 1004 (Technological resources Pty Ltd, Melbourne Australia)

The invention claimed is:

1. A process for producing solid carbon and gaseous oxygen from $CO_2$ via electrolysis using an electrolysis apparatus having a chamber with an electrolyte inlet, an electrolyte outlet, a pool of a liquid electrolyte containing $CO_2$ in the chamber, at least one cathode-anode pair, with the cathode including a pool of a liquid metal capable of catalysing reduction of $CO_2$ to solid carbon, and the liquid metal pool being in contact with the electrolyte pool, the process including supplying the electrolyte to the chamber via the inlet and discharging the electrolyte from the chamber via the outlet with the electrolyte flowing from the inlet to the outlet in fluid communication with the cathode-anode pair, applying a voltage between the cathode-anode pair and causing solid carbon to form on the cathode from $CO_2$ in the electrolyte and gaseous oxygen to be evolved at the anode from $CO_2$ in the electrolyte, and discharging solid carbon by transporting solid carbon from the cathode in the electrolyte to the electrolyte outlet and from the chamber via the outlet, and discharging gaseous oxygen from the chamber.

2. The process defined in claim 1 includes maintaining a pressure of 0-50 barg in the chamber.

3. The process defined in claim 1 includes supplying the electrolyte at a temperature up to 200° C. to the chamber.

4. The process defined in claim 1 includes applying a voltage in a range of 1 to 10 volts between the cathode-anode pair.

5. The process defined in claim 1 wherein the electrolyte includes dimethylformamide containing $CO_2$ in solution.

6. The process defined in claim 1 includes separating solid carbon from the electrolyte discharged from the electrolyte outlet and returning the electrolyte to the chamber via the electrolyte inlet.

7. The process defined in claim 6 includes regenerating the electrolyte by adding $CO_2$ to the electrolyte before returning the electrolyte to the chamber via the electrolyte inlet.

8. The process defined in claim 1 includes supplying the electrolyte to the chamber so that the electrolyte flowing through a gap between the cathode and the anode has a superficial liquid velocity in a range of 0.05-5 m/s.

9. A process for producing iron including: producing solid carbon and gaseous oxygen in accordance with the electrolysis process defined in claim 1, supplying iron ore, gaseous oxygen and a source of carbon to a direct smelter and direct smelting iron ore to molten iron and producing an off-gas containing $CO_2$, with the carbon source for the direct smelter including solid carbon produced in the electrolysis process, and with $CO_2$ in the off-gas from the direct smelter being used in the electrolysis process.

10. The process defined in claim 9 includes using gaseous oxygen from the electrolysis process as at least a part of the gaseous oxygen for direct smelting iron ore in the direct smelter.

11. A process for producing iron including: producing solid carbon and gaseous oxygen in accordance with the electrolysis process defined in claim 1 producing molten iron and an off-gas containing $CO_2$ in a blast furnace, with $CO_2$ in the off-gas from the blast furnace being used in the electrolysis process, and with solid carbon produced in the electrolysis process being used as a carbon source for the blast furnace.

12. The process defined in claim 11 includes mixing solid carbon from the electrolysis process and a binder and forming lumps of solid carbon, processing the lumps to coke, and supplying the coke to the blast furnace.

13. The process defined in claim 1 includes causing solid carbon to adhere only very weakly if at all to the liquid metal surface so electrolyte flow is sufficient to dislodge carbon and allow removal by simple convection.

14. A process for producing solid carbon and gaseous oxygen from $CO_2$ via electrolysis using an electrolysis apparatus having a chamber with an electrolyte inlet, an electrolyte outlet, a pool of a liquid electrolyte containing $CO_2$ in the chamber, at least one cathode-anode pair in the electrolyte pool, with the cathode including a pool of a liquid metal capable of catalysing reduction of $CO_2$ to solid carbon with the liquid metal pool having a depth of 1-50 mm, the process including maintaining a pressure of 0-50 barg in the chamber, supplying the electrolyte at a temperature up to 200° C. to the chamber via the inlet and discharging the electrolyte from the chamber via the outlet, with the electrolyte flowing from the inlet to the outlet in fluid communication with the cathode-anode pair, applying a voltage in a range of 1 to 10 volts between the cathode-anode pair and causing solid carbon to form on the cathode from $CO_2$ in the electrolyte and gaseous oxygen to be evolved at the anode from $CO_2$ in the electrolyte, and discharging solid carbon by transporting solid carbon from the cathode in the electrolyte to the electrolyte outlet and from the chamber via the outlet, and discharging gaseous oxygen from the chamber via a gas outlet.

15. The process defined in claim 14 includes supplying the electrolyte to the chamber via the inlet at a temperature between ambient and 90° C.

16. The process defined in claim 14 includes maintaining the pressure between 0-15 barg.

17. The process defined in claim 14 includes applying the voltage in a range of 1.5-3 volts between the cathode-anode pair.

18. The process defined in claim 14 includes causing solid carbon to adhere only very weakly if at all to the liquid metal surface so electrolyte flow is sufficient to dislodge carbon and allow removal by simple convection.

* * * * *